US010582280B2

(12) United States Patent
Clement et al.

(10) Patent No.: US 10,582,280 B2
(45) Date of Patent: Mar. 3, 2020

(54) PERSONAL WATERCRAFT WITH A SPEAKER ASSEMBLY

(71) Applicant: BOMBARDIER RECREATIONAL PRODUCTS INC., Valcourt (CA)

(72) Inventors: Sebastien Clement, Saint-Denis-de-Brompton (CA); Nicolas Roy, Richelieu (CA); Kim Ross, Valcourt (CA); Frederic Vachon, Granby (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 15/958,456

(22) Filed: Apr. 20, 2018

(65) Prior Publication Data

US 2018/0310081 A1 Oct. 25, 2018

Related U.S. Application Data

(60) Provisional application No. 62/487,868, filed on Apr. 20, 2017.

(51) Int. Cl.

| | |
|---|---|
| ***H04R 1/02*** | (2006.01) |
| ***H04R 1/28*** | (2006.01) |
| *B63B 35/73* | (2006.01) |

(52) U.S. Cl.

CPC ..... *H04R 1/02* (2013.01); *H04R 1/2896* (2013.01); *B63B 35/731* (2013.01)

(58) Field of Classification Search

CPC ..... H04R 1/02; H04R 1/025; H04R 1/028; H04R 1/2819; H04R 1/2896; H04R 1/44; H04R 5/02; H04R 5/023; H04R 2499/13

See application file for complete search history.

(56) References Cited

U.S. PATENT DOCUMENTS 5,001,779 A * 3/1991 Eggert ..... B60R 11/02 224/413

5,894,810 A * 4/1999 Orr ..... B60R 11/0205 114/343

(Continued)

OTHER PUBLICATIONS

JL Audio® SlamPak™ System for Yamaha FX WaveRunners. Datasheet [online]. Yamaha, [retrieved on Apr. 20, 2018]. Retrieved from the Internet: <URL: https://www.shopyamaha.com/product/details/jl-audio-slampak-system-for-yamaha-fx-waverunners?b=Boat&d=13&nw=yamaha-motor-company>.

(Continued)

*Primary Examiner* — Joshua Kaufman
(74) *Attorney, Agent, or Firm* — BCF LLP

(57) ABSTRACT

A personal watercraft includes a hull; a deck disposed on the hull, the deck including a pedestal; a straddle seat on the pedestal; a motor disposed between the hull and the deck; a propulsion system operatively connected to the motor; and at least one speaker assembly disposed at a forward portion of one of the left and right foot-wells. The speaker assembly includes a housing defining a bass port, and a water resistant speaker driver. The speaker driver includes a basket a plurality of apertures, the plurality of apertures being disposed in the interior of the housing, a cone supported by the basket, a surface of the cone fluidly communicating with air surrounding the basket via the plurality of apertures, a dust cap connected to the cone, a suspension element connected to the cone and the basket, and a water resistant voice coil assembly operatively connected to the cone.

19 Claims, 16 Drawing Sheets

(56) References Cited

U.S. PATENT DOCUMENTS

| | | | | |
|---|---|---|---|---|
| 8,139,810 | B2 * | 3/2012 | Armitage | B60R 11/0217 381/389 |
| 8,718,300 | B1 * | 5/2014 | Dixon | H04R 5/02 224/413 |
| 8,720,355 | B2 * | 5/2014 | Aoyama | B63B 17/00 114/343 |
| 8,861,775 | B2 * | 10/2014 | McPherson | H04R 1/026 381/120 |
| 2003/0044039 | A1 * | 3/2003 | Sterns | H04R 1/00 381/386 |
| 2005/0121935 | A1 * | 6/2005 | Bell | B62J 17/02 296/78.1 |
| 2007/0171315 | A1 * | 7/2007 | Aoyama | B63B 17/00 348/836 |
| 2009/0262963 | A1 * | 10/2009 | Inoue | H04R 3/12 381/302 |
| 2010/0092015 | A1 * | 4/2010 | McPherson | H04R 1/026 381/307 |
| 2016/0165329 | A1 * | 6/2016 | Fedyay | B63B 17/00 |
| 2018/0184198 | A1 * | 6/2018 | Cross | H04R 1/2834 |
| 2018/0206030 | A1 * | 7/2018 | Cross | H04R 1/44 |
| 2018/0310081 | A1 * | 10/2018 | Clement | H04R 1/02 |
| 2018/0317004 | A1 * | 11/2018 | Sheedy | B63B 49/00 |

OTHER PUBLICATIONS

Hemmel, Jeff "2016 Kawasaki Jet Ski Ultra 310LX Review". In PersonalWatercraft.com [online]. Jun. 7, 2016 [retrieved on Apr. 20, 2018]. Retrieved from the Internet: <URL: http://www.personalwatercraft.com/blog/2016/06/2016-kawasaki-jet-ski-ultra-310lx-review.html?utm_content=buffer675e6&utm_medium=social&utm_source=plus.google.com&utm_campaign=buffer>.

* cited by examiner

PERSONAL WATERCRAFT WITH A SPEAKER ASSEMBLY

CROSS-REFERENCE

The present application claims priority to U.S. Provisional Patent Application 62/487,868, filed Apr. 20, 2017, entitled "Personal Watercraft with a Speaker Assembly," the entirety of which is incorporated herein by reference.

TECHNICAL FIELD

The present technology relates to a personal watercraft including one or more speaker assemblies.

BACKGROUND

Personal watercraft are often employed as recreational vehicles and some such watercraft are provided with speaker assemblies, also known as speaker systems, to allow operators to listen to music while on their watercraft. While many different speaker assemblies exist, the wet environment of watercraft adds an additional consideration in the design and integration of such speaker assemblies.

Some watercraft, such as sports boats, are built with marine speakers built into their deck. These speakers have a waterproof surround, cone, and dust cap which prevent water from infiltrating the deck through the speaker. As such, the interior of the speaker remains a dry environment, protecting the components that are sensitive to water damage, such as the electronics and voice coil assembly. The components are only kept in a dry environment, however, if water does not enter from elsewhere into the space between the deck and hull. Some watercraft are more likely to have water enter the space below the deck than larger boats, and water entering below deck can damage sensitive speaker components.

Further, creating a sealed environment around a speaker is known in the art to negatively affect sound quality. A bass port is sometimes added to allow better transmission of bass (low) frequencies out of the speaker housing. As mentioned above, however, additional holes in the marine speaker could allow the incursion of water, resulting in damage to those sensitive electronic components.

After-market waterproof speakers are also available to be installed on different types of watercraft. These speakers are usually in the form of sealed pods that are mounted external to the deck. While these sealed speaker pods do not risk water damage to the sensitive internal components of the speakers, the pods are generally connected to a power source within the watercraft, requiring the additional expense of installing wiring along or through the deck. Additionally, any holes drilled for installation of wiring through the deck can increase the risk of water entering below the deck through those holes.

As mentioned above, sealed speakers do not produce optimal sound quality. In some instances, an additional subwoofer is included to be installed in cooperation with the speaker pods to at least partially overcome this diminished sound quality. The subwoofer can improve sound quality for bass frequencies, but the addition of the subwoofer takes up additional space on or inside the watercraft, as well as increases overall cost of the speaker system.

Therefore, there remains a desire for a personal watercraft with speakers with good sound quality and cost, and that can further withstand the rigors of being installed on or in a personal watercraft.

SUMMARY

It is an object of the present technology to ameliorate at least some of the inconveniences present in the prior art.

According to an aspect of the present technology, there is provided a personal watercraft with a speaker assembly installed at a forward portion of one or both of the foot-wells. The speaker assembly includes a speaker driver that has a water impermeable chamber for providing a dry environment for a voice coil assembly, such that water entering into the speaker assembly does not damage the voice coil assembly. The presence of the water impermeable chamber for protecting the voice coil assembly allows the speaker assembly to support having a wet environment within its housing. The speaker assembly housing thus defines a bass port for improving transmission of bass frequencies, the bass port being directed toward the foot-well to direct sound to reflect upward and rearward toward an operator.

According to an aspect of the present technology, there is provided a personal watercraft including a hull; a deck disposed on the hull, the deck including a pedestal, a left foot-well disposed on a left side of the pedestal, and a right foot-well disposed on a right side of the pedestal; at least one straddle seat disposed on the pedestal; a motor disposed between the hull and the deck; a propulsion system connected to at least one of the hull and the deck and operatively connected to the motor; and at least one speaker assembly disposed at a forward portion of at least one of the left foot-well and the right foot-well, the at least one speaker assembly including a housing defining a bass port, and a water resistant speaker driver connected to the housing, the speaker driver including a basket connected to the housing, the basket defining a plurality of apertures, at least a portion of the basket being disposed in an interior of the housing, the plurality of apertures being disposed in the interior of the housing, a cone supported by the basket, a surface of the cone fluidly communicating with air surrounding the basket via the plurality of apertures, a dust cap connected to the cone, a suspension element operatively connected to the cone and the basket, and a water resistant voice coil assembly operatively connected to the cone.

In some implementations, the at least one speaker assembly further includes an amplifier disposed within the housing, the amplifier being electrically connected to and adapted for driving the speaker driver.

In some implementations, the bass port is defined by a pipe defined at least in part by a foot-well side surface of the housing, the foot-well side surface being a surface of the housing nearest to the at least one of the left foot-well and the right foot-well.

In some implementations, the bass port of the at least one speaker assembly faces a surface of the at least one of the left foot-well and the right foot-well.

In some implementations, each of the left foot-well and the right foot-well includes an angled surface disposed at the forward portion of the foot-well; and the bass port of the at least one speaker assembly faces the angled surface of the at least one of the left foot-well and the right foot-well.

In some implementations, the at least one speaker assembly further includes a control unit connected to the housing, the control unit being electronically connected to the speaker driver.

In some implementations, the control unit includes buttons disposed on a top portion of the control unit for controlling operation of the speaker driver; and the top portion of the control unit is disposed on an external surface of the housing.

In some implementations, the control unit includes a wireless receiver for connecting wirelessly with a user electronic device.

In some implementations, the speaker driver further includes a surround connected to an edge of a geometric base of the cone; and a waterproof tweeter assembly connected to the basket, the basket connecting the speaker driver to the housing.

In some implementations, a centerline of the cone of the speaker driver extends upward and rearward from the speaker assembly such that sound emanating from the speaker driver is directed at least partially upward and rearward from the speaker assembly.

In some implementations, the centerline of the cone extends laterally inward from the speaker assembly such that sound emanating from the speaker driver is directed at least partially laterally inward from the speaker assembly.

In some implementations, the housing defines at least one drainage hole for allowing at least a portion of water passing into the housing to drain out of the at least one speaker assembly.

In some implementations, the personal watercraft further includes a battery; and the at least one speaker assembly is electrically connected to the battery for receiving power therefrom.

In some implementations, the at least one speaker assembly includes a left speaker assembly and a right speaker assembly; the left speaker assembly is disposed at the forward portion of the left foot-well; and the right speaker assembly is disposed at the forward portion of the right foot-well.

In some implementations, the personal watercraft further includes a power source; and one of the right speaker assembly and the left speaker assembly further includes an amplifier connected to the speaker driver and the power source, and a control unit connected to the speaker driver and the power source; and an other one of the right speaker assembly and the left speaker assembly is connected to the amplifier and the control unit via a cable disposed under a top surface of the deck, the other one of the right speaker assembly and the left speaker assembly being controlled and powered via the cable.

In some implementations, the power source is a battery disposed between the deck and the hull.

In some implementations, the control unit includes a wireless receiver for connecting wirelessly with a user electronic device.

In some implementations, a centerline of the cone of the speaker driver of the left speaker assembly extends upward, rearward, and rightward from the left speaker assembly such that sound emanating from the left speaker driver is directed at least partially upward, rearward, and rightward from the left speaker assembly; and a centerline of the cone of the speaker driver of the right speaker assembly extends upward, rearward, and leftward from the right speaker assembly such that sound emanating from the right speaker driver is directed at least partially upward, rearward, and leftward from the right speaker assembly.

In some implementations, the deck includes at least one deck panel; the at least one deck panel defines a recess for selectively receiving the at least one speaker assembly partially therein; and lateral sides of the at least one speaker assembly are at least partially covered by the at least one deck panel.

According to an aspect of the present technology, there is provided a personal watercraft including a hull; a deck disposed on the hull, the deck including a pedestal, the deck defining at least one recess, the recess opening rearwardly and upwardly from the deck; at least one straddle seat disposed on the pedestal; a motor disposed between the hull and the deck; a propulsion system connected to at least one of the hull and the deck and operatively connected to the motor; and at least one speaker assembly disposed in the at least one recess, the at least one speaker assembly including a housing, and a speaker driver connected to the housing, the speaker driver including a basket connected to the housing, at least a portion of the basket being disposed in an interior of the housing, a cone supported by the basket, a dust cap connected to the cone, a suspension element operatively connected to the cone and the basket, and a voice coil assembly operatively connected to the cone.

In some implementations, the deck includes at least one deck panel; and lateral sides of the at least one speaker assembly are at least partially covered by the at least one deck panel.

In some implementations, the at least one speaker assembly further includes an amplifier disposed within the housing, the amplifier being electrically connected to and adapted for driving the speaker driver.

In some implementations, the at least one speaker assembly further includes a control unit connected to the housing, the control unit being electronically connected to the speaker driver.

In some implementations, the control unit includes buttons disposed on a top portion of the control unit for controlling operation of the speaker driver; and the top portion of the control unit is disposed on an external surface of the housing.

In some implementations, the control unit includes a wireless receiver for connecting wirelessly with a user electronic device.

In some implementations, the speaker driver further includes a surround connected to an edge of a geometric base of the cone; and a waterproof tweeter assembly connected to the basket, the basket connecting the speaker driver to the housing.

In some implementations, a centerline of the cone of the speaker driver extends upward and rearward from the speaker assembly such that sound emanating from the speaker driver is directed at least partially upward and rearward from the speaker assembly.

In some implementations, the centerline of the cone extends laterally inward from the speaker assembly such that sound emanating from the speaker driver is directed at least partially laterally inward from the speaker assembly.

In some implementations, the housing defines at least one drainage hole for allowing at least a portion of water passing into the housing to drain out of the at least one speaker assembly.

In some implementations, the personal watercraft further includes a battery and the at least one speaker assembly is electrically connected to the battery for receiving power therefrom.

In some implementations, the at least one recess includes a left recess and a right recess; the at least one speaker assembly includes a left speaker assembly and a right speaker assembly; the left speaker assembly is disposed in the left recess; and the right speaker assembly is disposed in the right recess.

In some implementations, the personal watercraft further includes a power source; and one of the right speaker assembly and the left speaker assembly further includes an amplifier connected to the speaker driver and the power source, and a control unit connected to the speaker driver and the power source; and an other one of the right speaker assembly and the left speaker assembly is connected to the amplifier and the control unit via a cable disposed under a top surface of the deck, the other one of the right speaker assembly and the left speaker assembly being controlled and powered via the cable.

In some implementations, the power source is a battery disposed between the deck and the hull.

In some implementations, the control unit includes a wireless receiver for connecting wirelessly with a user electronic device.

In some implementations, a centerline of the cone of the speaker driver of the left speaker assembly extends upward, rearward, and rightward from the left speaker assembly such that sound emanating from the left speaker driver is directed at least partially upward, rearward, and rightward from the left speaker assembly; and a centerline of the cone of the speaker driver of the right speaker assembly extends upward, rearward, and leftward from the right speaker assembly such that sound emanating from the right speaker driver is directed at least partially upward, rearward, and leftward from the right speaker assembly.

According to an aspect of the present technology, there is provided a personal watercraft including a hull; a deck disposed on the hull, the deck including a pedestal, the deck defining at least one recess, the recess opening rearwardly and upwardly from the deck; at least one straddle seat disposed on the pedestal; a motor disposed between the hull and the deck; a propulsion system connected to at least one of the hull and the deck and operatively connected to the motor; and at least one speaker assembly disposed in the at least one recess, the at least one speaker assembly including a housing, and a speaker driver connected to the housing, the speaker driver including a basket connected to the housing, at least a portion of the basket being disposed in an interior of the housing, a cone supported by the basket, a dust cap connected to the cone, a suspension element operatively connected to the cone and the basket, and a voice coil assembly operatively connected to the cone.

In some implementations, the deck comprises at least one deck panel; and lateral sides of the at least one speaker assembly are at least partially covered by the at least one deck panel.

In some implementations, the at least one speaker assembly further comprises an amplifier disposed within the housing, the amplifier being electrically connected to and adapted for driving the speaker driver.

In some implementations, the at least one speaker assembly further comprises a control unit connected to the housing, the control unit being electronically connected to the speaker driver.

In some implementations, the control unit includes buttons disposed on a top portion of the control unit for controlling operation of the speaker driver; and the top portion of the control unit is disposed on an external surface of the housing.

In some implementations, the control unit includes a wireless receiver for connecting wirelessly with a user electronic device.

In some implementations, the speaker driver further includes a surround connected to an edge of a geometric base of the cone; and a waterproof tweeter assembly connected to the basket, the basket connecting the speaker driver to the housing.

In some implementations, a centerline of the cone of the speaker driver extends upward and rearward from the speaker assembly such that sound emanating from the speaker driver is directed at least partially upward and rearward from the speaker assembly.

In some implementations, the centerline of the cone extends laterally inward from the speaker assembly such that sound emanating from the speaker driver is directed at least partially laterally inward from the speaker assembly.

In some implementations, the housing defines at least one drainage hole for allowing at least a portion of water passing into the housing to drain out of the at least one speaker assembly.

In some implementations, the personal watercraft further includes a battery; and the at least one speaker assembly is electrically connected to the battery for receiving power therefrom.

In some implementations, the at least one recess includes a left recess and a right recess; the at least one speaker assembly includes a left speaker assembly and a right speaker assembly; the left speaker assembly is disposed in the left recess; and the right speaker assembly is disposed in the right recess.

In some implementations, the personal watercraft further includes a power source; and one of the right speaker assembly and the left speaker assembly further includes an amplifier connected to the speaker driver and the power source, and a control unit connected to the speaker driver and the power source; and an other one of the right speaker assembly and the left speaker assembly is connected to the amplifier and the control unit via a cable disposed under a top surface of the deck, the other one of the right speaker assembly and the left speaker assembly being controlled and powered via the cable.

In some implementations, the power source is a battery disposed between the deck and the hull.

In some implementations, the control unit comprises a wireless receiver for connecting wirelessly with a user electronic device.

In some implementations, a centerline of the cone of the speaker driver of the left speaker assembly extends upward, rearward, and rightward from the left speaker assembly such that sound emanating from the left speaker driver is directed at least partially upward, rearward, and rightward from the left speaker assembly; and a centerline of the cone of the speaker driver of the right speaker assembly extends upward, rearward, and leftward from the right speaker assembly such that sound emanating from the right speaker driver is directed at least partially upward, rearward, and leftward from the right speaker assembly.

For purposes of this application, terms related to spatial orientation such as forwardly, rearward, upwardly, downwardly, left, and right, are as they would normally be understood by a driver of the vehicle sitting thereon in a normal riding position. Terms related to spatial orientation when describing or referring to components or sub-assemblies of the vehicle, separately from the vehicle, such as a deck or hull for example, should be understood as they would be understood when these components or sub-assemblies are mounted to the vehicle, unless specified otherwise in this application. The term "straddle-type seat" refers to a seat on which a person normally sits astride. The term "motor" can refer to any component capable of driving the motion of a watercraft, which includes but is not limited to an internal combustion engine or an electric motor. The term "water resistant" relates to elements or components that are not damaged by exposure to water. The term "water impermeable" relates to elements or components that are made or treated such that water cannot enter into or pass through the element or component.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
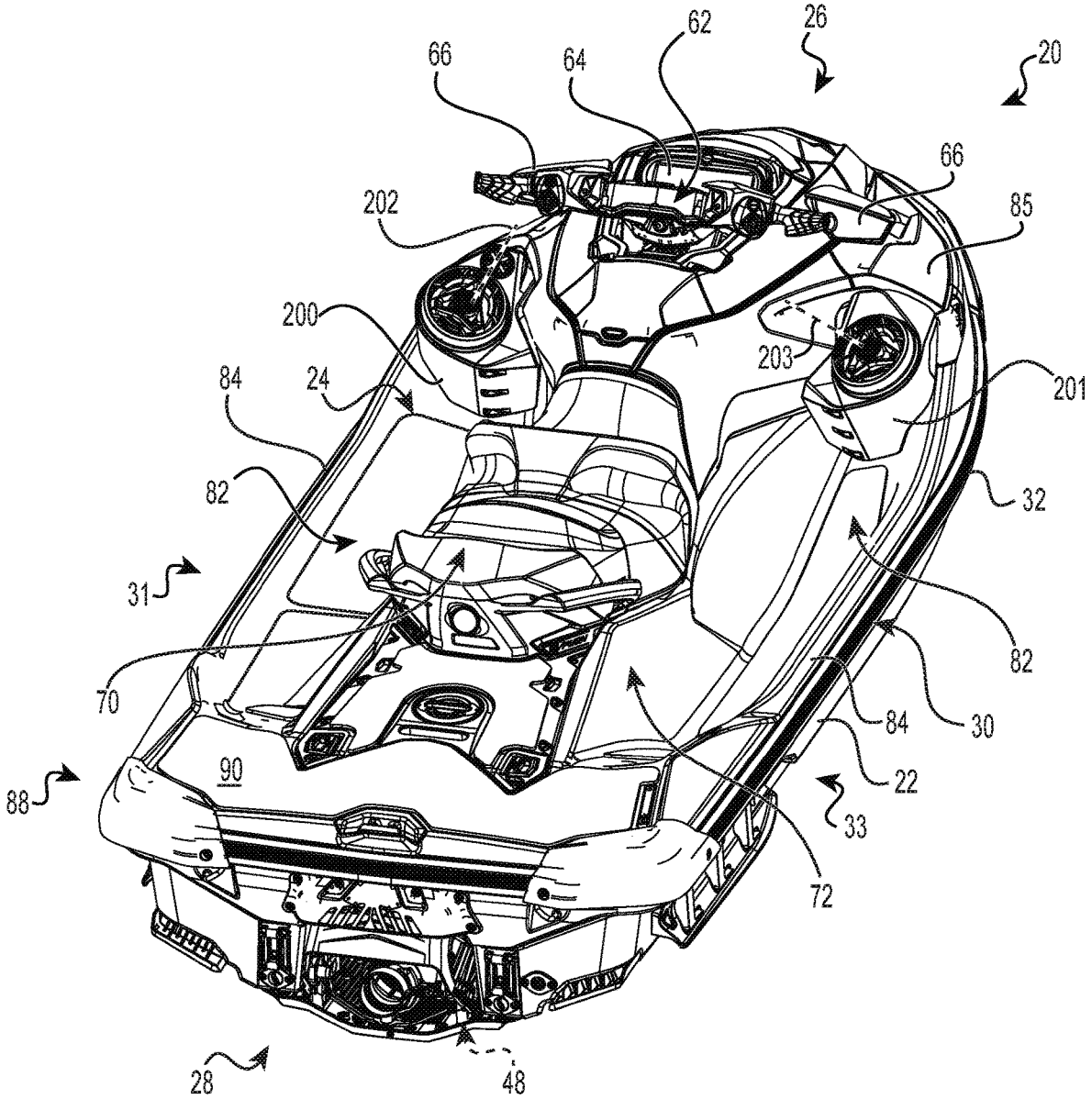
FIG. 1 is a top, rear, right side perspective view of a personal watercraft.
Figure 2:
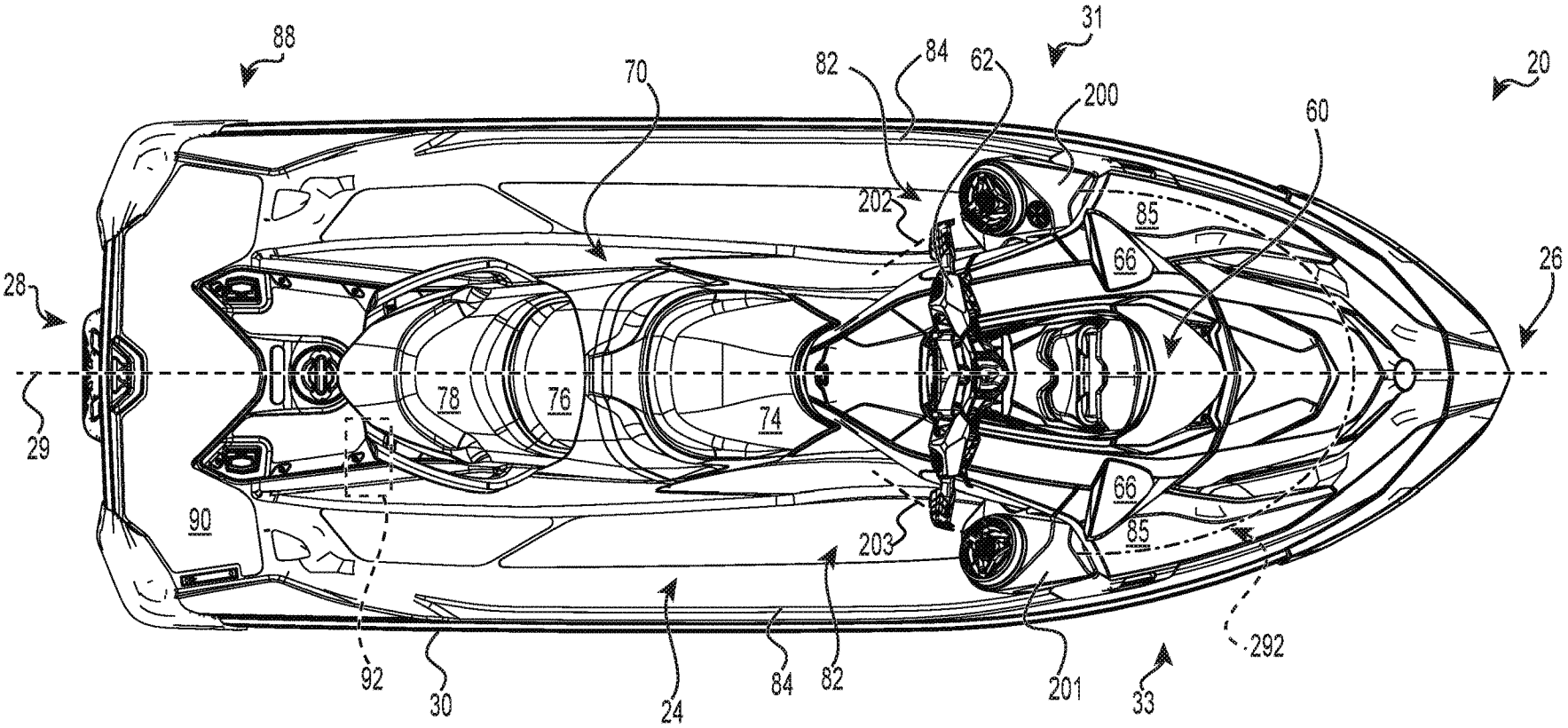
FIG. 2 is a top plan view of the watercraft of FIG. 1.
Figure 3:
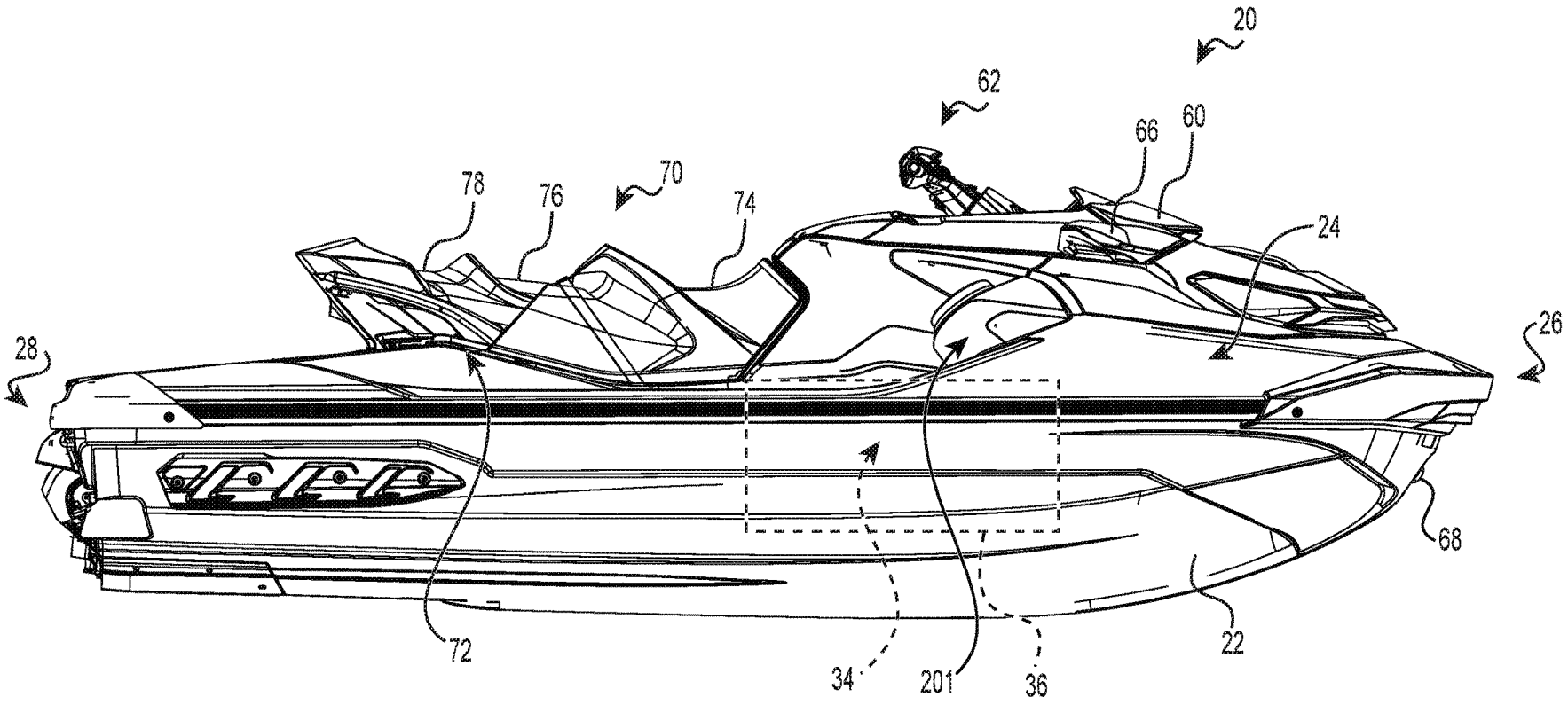
FIG. 3 is a right side elevation view of the watercraft of FIG. 1.

Referring to FIGS. 1 to 3, an implementation of a personal watercraft 20 is shown. The personal watercraft 20 has a hull 22 and a deck 24. The hull 22 and the deck 24 are made of glass fiber-reinforced composite material. It is contemplated that other suitable materials could be used to make the hull 22 and the deck 24. The hull 22 buoyantly supports the watercraft 20 in the water. The hull 22 has a bow 26 and a stern 28. A longitudinal centerline 29 extends between the bow 26 and the stern 28 and splits the deck 24 into a left longitudinal side 31 and a right longitudinal side 33 (FIG. 2). For the purpose of the following description, the components that are qualified as "left" or "right" are positioned on the corresponding left longitudinal side 31 and right longitudinal side 33 of the deck 24.

Figure 4:
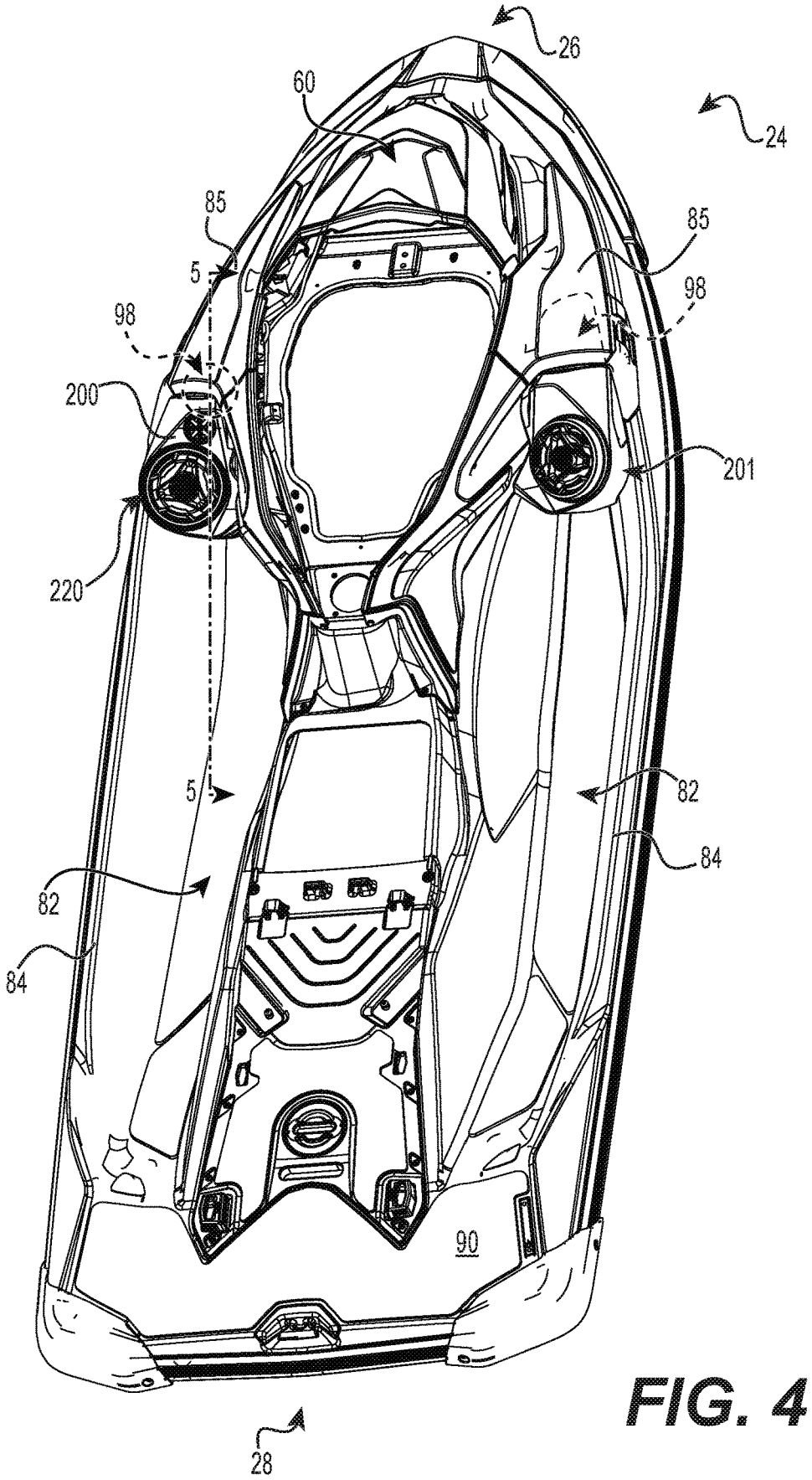
FIG. 4 is a top, rear, right side perspective view of a deck of the watercraft of FIG. 1.

The deck 24 is designed to accommodate an operator and two passengers. It is contemplated that the deck 24 could be designed to accommodate only the operator or more or fewer passengers. The deck 24 is shown in isolation in FIG. 4. The hull 22 and the deck 24 are joined together at a seam 30 that joins the parts in a sealing relationship. The seam 30 includes a bond line formed by an adhesive. Other known joining methods could be used to sealingly engage the parts together, including but not limited to thermal fusion, molding or fasteners such as rivets, bolts or screws used in conjunction with a gasket. A bumper 32 generally covers the seam 30. The bumper 32 helps to prevent damage to the outer surface of the watercraft 20 when the watercraft 20 is docked, for example. The bumper 32 can extend around the bow 26 and the stern 28, as shown, or around any portion or the entire seam 30.

The space between the hull 22 and the deck 24 forms a volume commonly referred to as the motor compartment 34 (FIG. 3). The motor compartment 34 accommodates a motor 36, in the form of an internal combustion engine, but other types of motors are contemplated. The motor compartment 34 also houses a battery 92, shown schematically in FIG. 2. The motor compartment 34 further houses intake, exhaust, fuel, and electrical systems (electronic control unit, etc.), and other elements required or desirable in the watercraft 20. The motor 36 drives a water jet propulsion system 48 of the personal watercraft 20, though other types of propulsion systems are contemplated in other implementations.

Still referring to FIGS. 1 to 3, towards the bow 26, the deck 24 has a hood 60 including a helm assembly 62, for steering the watercraft 20, and an instrument cluster 64. Left and right rear-view mirrors 66 are positioned on corresponding left and right sides of the hood 60 to allow the operator to see behind the watercraft 20. A hook 68 is located at the bow 26 of the hull 22 (FIG. 3). The hook 68 is used to attach the watercraft 20 to a dock when the watercraft 20 is not in use or to attach to a winch when loading the watercraft 20 on a trailer, for instance.

The deck 24 has a centrally positioned straddle-type seat 70 supported on top of a pedestal 72 formed by the deck 24. Accordingly, the seat 70 and the pedestal 72 are aligned with the longitudinal centerline 29 of the deck 24. The seat 70 accommodates three riders in a straddling position. The seat 70 has a front seat portion 74, a middle seat portion 76 and a rear seat portion 78 made as cushioned or padded units.

On left and right sides of the pedestal 72, the deck 24 forms foot-wells 82 that provide support for the riders' feet. With additional reference to FIG. 5, the foot-wells 82 include an angled surface 83 at a forward portion of each of the foot-wells 82. Along the foot-wells 82, the watercraft 20 has a pair of generally upwardly extending walls located on either side of the watercraft 20 known as gunwales or gunnels 84. The gunnels 84 help to prevent the entry of water in the foot-wells 82 of the watercraft 20, provide lateral support for the riders' feet, and also provide buoyancy when turning the watercraft 20, since the personal watercraft 20 can roll slightly when turning. Towards the bow 26, fairings 85, also referred to as panels 85, extend between the gunnels 84 and the hood 60 and further prevent the entry of water in the foot-wells 82. Forward of a rear end 88 of the deck 24, the deck 24 includes a reboarding platform 90 allowing a rider to easily reboard the watercraft 20 from the water. The reboarding platform 90 extends laterally over a width of the deck 24, between the left longitudinal side 31 and the right longitudinal side 33 of the deck 24.

The personal watercraft 20 has other features and components which would be readily recognized by one of ordinary skill in the art. Further explanation and description of these components will not be provided herein.

The personal watercraft 20 includes a left speaker assembly 200 and a right speaker assembly 201. The left speaker assembly 200 will first be described with reference to FIGS. 4 to 12; the right speaker assembly 201 will be described in more detail below with reference to FIGS. 15 to 17. As can be seen in FIGS. 1 to 4, the speaker assembly 200 is disposed at a front end of the left foot-well 82 of the watercraft 20. It is contemplated that the speaker assembly 200 could be disposed at a front end of the right foot-well 82. It is also contemplated that two speaker assemblies 200 could be included in some implementations of the watercraft 20.

The speaker assemblies 200, 201 are partially disposed in recesses 98 (see FIGS. 4 and 5), formed by the deck 24. Portions of lateral sides of the speaker assemblies 200, 201 are covered by the panels 85 of the watercraft 20. It is contemplated the one or both of the speaker assemblies 200, 201 could be removable from the watercraft 20, such that one or both of the speaker assemblies 200, 201 could be used apart from the watercraft 20. In such a case, a cord 292 (described below) would be selectively disconnectable, and a power supply would be either disposed within the speaker assemblies 200, 201, or selectively connectable when the speaker assemblies 200, 201 are removed from the watercraft 20.

The speaker assembly 200 includes a housing 204. The housing 204 is made up of an inner panel 206 and an outer panel 208 snapped and fastened together. It is contemplated that the panels 206, 208 could be connected in various ways, including but not limited to: fastened, glued, and welded. It is also contemplated that the housing 204 could be made up of more or fewer panels.

Figure 7:
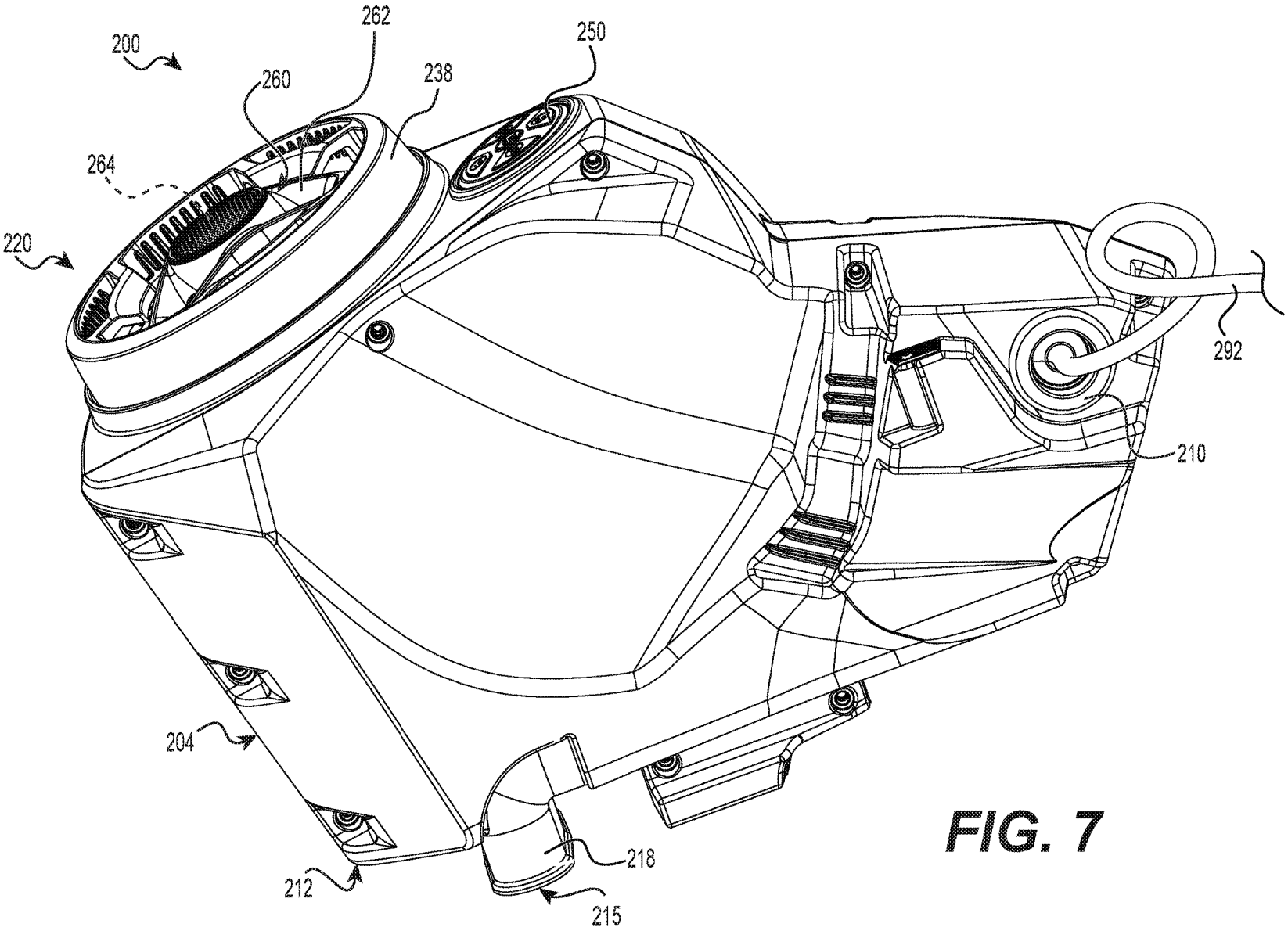
FIG. 7 is a right side elevation view of the left speaker assembly of FIG. 6.
Figure 8:
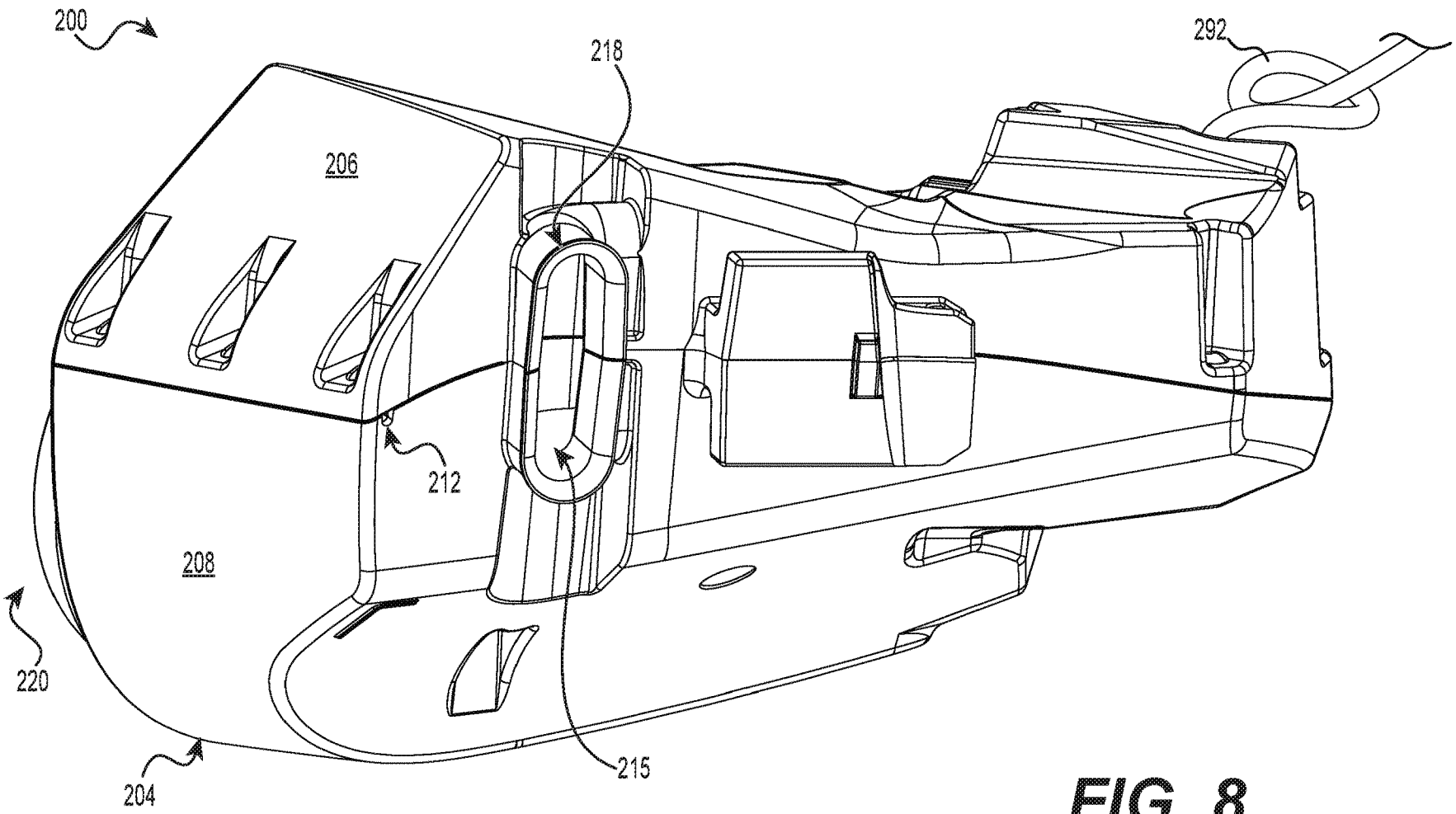
FIG. 8 is a bottom plan view of the left speaker assembly of FIG. 6.

As can be seen from FIGS. 7 and 8, the outer panel 208 defines a drainage hole 212 that is near the lowest point in the housing 204 to allow water passing into the housing 204 to drain out of the speaker assembly 200. It is contemplated that the drainage hole 212 could be omitted. The inner panel 206 includes a grommet 210 through which passes an electrical cable 292, or cord 292, which will be described in more detail below. The grommet 210 generally forms an airtight seal around the cord 292 to prevent sound waves from escaping the housing 204 therethrough.

Figure 9:
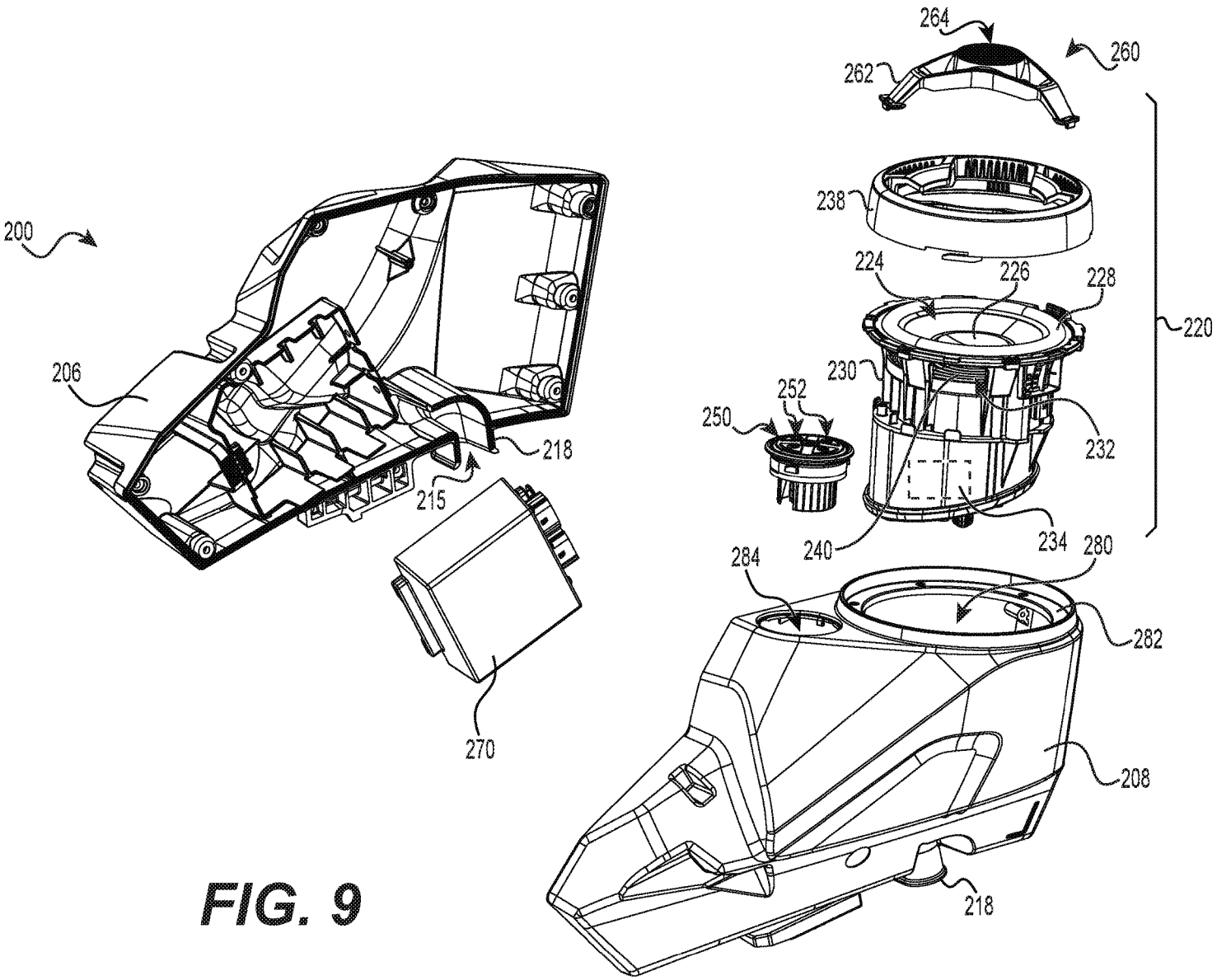
FIG. 9 is an exploded view of the left speaker assembly of FIG. 6.
Figure 14:
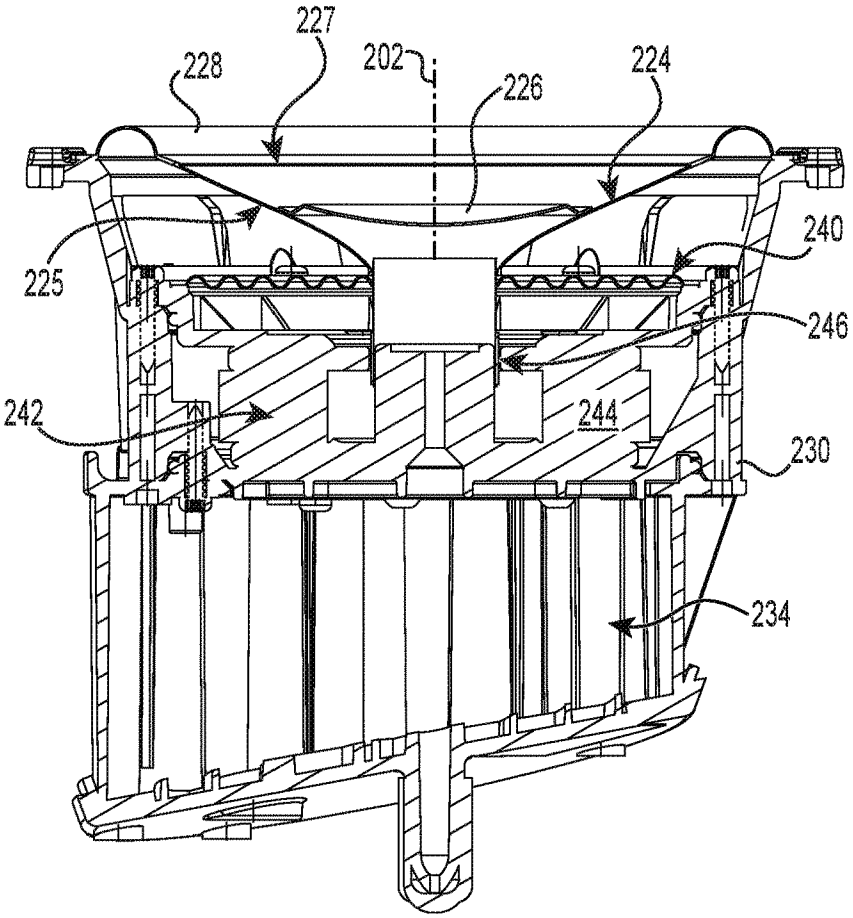
FIG. 14 is a cross-sectional view of the speaker driver of FIG. 13, taken along line 14-14 of FIG. 13.
Figure 13:
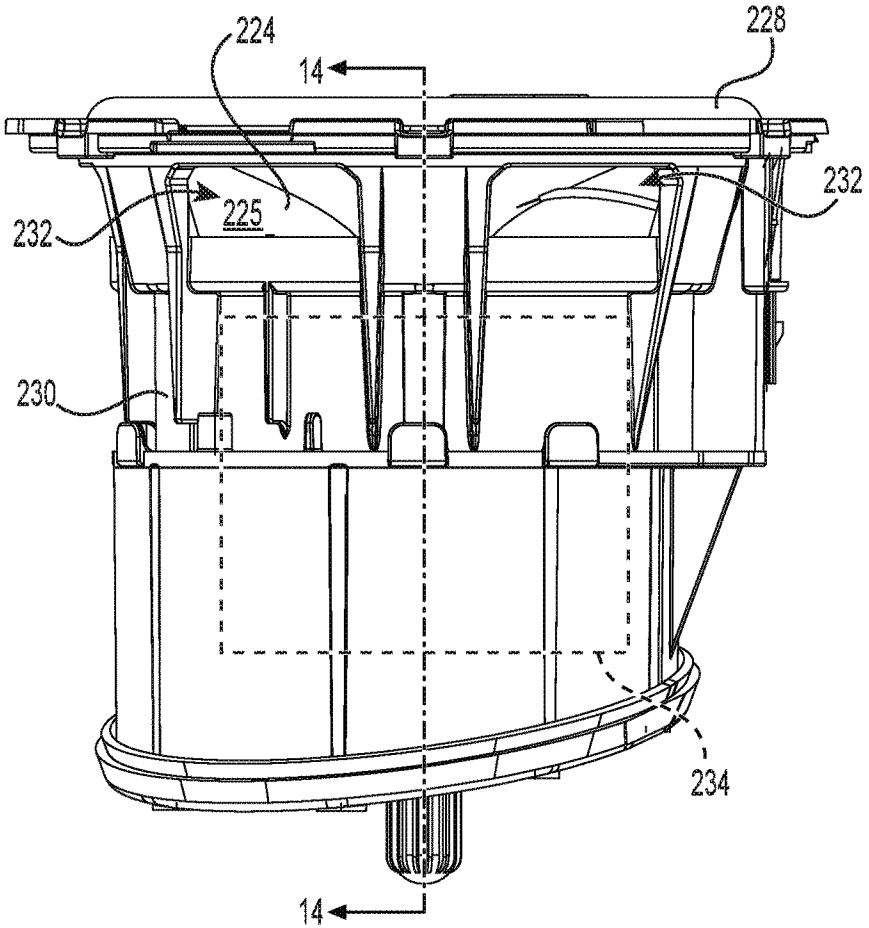
FIG. 13 is a left, rear side perspective view of a speaker driver of the left speaker assembly of FIG. 6.

The speaker assembly 200, as can be seen in an exploded view of the assembly 200 in FIG. 9, includes a water resistant speaker driver 220 that converts an electrical audio signal to sound waves. The speaker driver 220 is water resistant, such that water incident on the speaker driver 220 from within the housing 204 or from outside the housing 204 does not substantially damage the speaker driver 220. There are various ways in which this could be accomplished, and the present technology need not be restricted to any specific solution. Described below with further reference to FIGS. 13 and 14 is one particular implementation of the water resistant speaker driver 220, but it is contemplated that different implementations of a water resistant speaker driver could be included in the speaker assembly 200.

The speaker driver 220 is connected to the housing 204 and disposed partially in an interior of the housing 204. The speaker driver 220 includes a basket 230, which acts as a frame supporting different components of the speaker driver 220. The basket 230 connects the speaker driver 220 to the outer panel 208 of the housing 204. The outer panel 208 defines an aperture 280 on its top side for receiving the speaker driver 220 therein, and a top portion of the basket 230 sits on a lip 282 formed around the aperture 280 (see FIG. 9). An upper portion of the basket 230 defines a plurality of apertures 232, as will be described in more detail below.

The speaker driver 220 also includes a protective cover 238 connected around a top edge of the basket 230. The cover 238 is composed of hardened plastic, but many different weather resistant rigid materials may be employed. It is also contemplated that the speaker driver 220 could be provided without the protective cover 238 in some implementations.

A tweeter assembly 260 is included with the speaker driver 220 to provide enriched high frequency sounds according to known technologies. The tweeter assembly 260 includes a tweeter bridge 262 connected to the basket 230. The tweeter bridge 262 supports a tweeter driver 264. It is contemplated that the speaker driver 220 could be provided without the tweeter assembly 260 in some implementations. It is contemplated that the tweeter assembly 260 could be realized in a variety of implementations, although tweeter the assembly 260 should be water impermeable for implementations where the tweeter bridge 262 extends over a top surface of the speaker driver 220.

The speaker driver 220 includes a cone 224 moveably supported in the basket 230. The cone 224 is made of plastic, but it is contemplated that the cone 224 could be made of any stiff material that is resistant to water damage. It is also contemplated that the cone 224 could be made of any number of materials, alone or in combination, and/or protected with a thin water impermeable covering, such as lamination. In some implementations, the cone 224 could be made of a water resistant material that allows water to permeate the cone 224, depending on other specifics of the design of the speaker driver 220.

The speaker driver 220 further includes a flexible membrane 228, also referred to as a surround 228. The surround 228 flexibly connects the cone 224 to the basket 230. As can be seen in FIG. 14, an edge 227 of a geometric base of the cone 224 is connected to the surround 228.

The water resistant speaker driver 220 also includes a water resistant voice coil assembly 242 (see FIG. 14) disposed in the basket 230. The voice coil assembly 242 includes a voice coil 246 connected to the cone 224. A magnet assembly 244 is disposed in the basket 230 and partially surrounds the voice coil 246. The speaker driver 220 operates as is generally known in the field of speakers. The voice coil 246 includes wire coils through which current is passed to produce magnetic fields. Depending on a direction of the current passed through the voice coil 246, magnetic field interaction between the voice coil 246 and the magnet assembly 244 moves the voice coil 246 toward or away from the magnet assembly 244. This movement of the voice coil 246 thereby drives the cone 224; movement of the cone 224 in turn produces sounds waves in air.

The speaker driver 220 also includes a water impermeable cap 226, also referred to as a water impermeable dust cap 226, disposed in the cone 224. As can be seen in FIG. 14, a center edge of the cone 224 connects to the voice coil 246, the cone 224 being open at its center portion. In order to protect the voice coil 246 from dust, water and other contaminants running down an interior surface of the cone 224, the cap 226 is disposed over that center portion of the cone 224 and is sealingly connected thereto. It is contemplated that the cap 226 could be larger or smaller than is illustrated in the present implementation. It is also contemplated that the cap 226 could be integral with the cone 224.

The speaker driver 220 includes a water impermeable suspension element 240, also referred to as a spider 240, operatively connected between the cone 224 and the basket 230. The spider 240 acts as an additional flexible membrane for flexibly supporting the cone 224 and the voice coil 246. The spider 240 is made of laminated polycotton and rubber, and is thus impermeable to water. The spider 240 could be made of different water impermeable and flexible materials, depending on the implementation. In some implementations, the spider 240 could be permeable to air while being impermeable to water. The spider 240 defines, along with a lower portion of the basket 230 and the water impermeable cap 226, a water impermeable chamber 234. The lower portion of the basket 230 is closed below the apertures 232 and the spider 240 is connected to the basket 230 just below the apertures 232 (see FIGS. 13 and 14).

The voice coil assembly 242 is disposed within the water impermeable chamber 234 and is therefore water resistant. The voice coil assembly 242 is protected from water that enters the housing 204 of the speaker assembly 200 for reasons which are detailed below. The housing 204 is therefore not required to be a dry environment. It should be noted that portions of the magnet assembly 244 may not be sensitive to water damage, and it is contemplated that all or a portion of the magnet assembly 244 could be disposed outside the basket 230 or outside the water impermeable chamber 234. In different implementations of the water resistant speaker driver 220, other solutions for protecting the voice coil 246 and/or the voice coil assembly 242 could be implemented. In one non-limiting example, it is contemplated that the voice coil assembly 242 could be appropriately coated with a water impermeable material, and as such would not need to be disposed in the water impermeable chamber 234.

The housing 204 of the speaker assembly 200 defines an aperture 215 passing through the panels 206, 208, specifically a bass port 215. The bass port 215 is defined by a pipe 218. The pipe 218 is formed in part by each of the panels 206, 208. It is contemplated that the pipe 218 could be formed in only one of the panels 206, 208. The pipe 218 serves in part to allow water to drain out of the housing 204. It is contemplated that in some implementations, the drainage hole 212 could be omitted and the pipe 218 could serve to allow drainage of water out of the housing 204. Further specific details relating to the function of the bass port 215 and the pipe 218 are described below.

The speaker assembly 200 also includes a control unit 250 electronically connected to the speaker driver 220. The control unit 250 provides buttons 252 on a top portion of the unit 250 to receive commands from the operator to control the speaker driver 220 (as well as the speaker driver 220 of the right speaker assembly 201, as will be described below). The top portion of the control unit 250 is disposed on a top, operator-facing side of the housing 204 in an aperture 284 (FIG. 9), for easy access for the operator. It is contemplated that the control unit 250 could instead be disposed on the helm assembly 62, such that the buttons 252 could be used by the operator without the need to remove their hands from the helm. It is also contemplated that the control unit 250 could be split into multiple devices, for example where a control unit of the watercraft 20 controls the speaker assemblies 200, 201, with buttons controlling the speaker assemblies 200, 201 being disposed on the helm assembly 62. It is further contemplated that the control unit 250 could be included in the right speaker assembly 201 instead of the left speaker assembly 200.

The control unit 250 includes a wireless receiver 254 (shown schematically in FIG. 10) for wirelessly connecting to a user electronic device, including, but not limited to, a smart phone, an mp3 player, and a wireless stereo. It is contemplated that the control unit 250 could additionally or alternatively include a cord for physically connecting to an electronic device. It is also contemplated that the control unit 250 could connect by wire or wirelessly to a radio or sound system built-in to the personal watercraft 20. As the interior of the housing 204 may be a wet environment, it should be noted that the control unit 250 should be sufficiently water resistant to protect its electronics from the possibility of water damage.

The speaker assembly 200 also includes an amplifier 270 disposed within the housing 204. The amplifier 270 is electronically and electrically connected to the control unit 250 and the speaker driver 220. The amplifier 270 drives the speaker driver 220 based on signals received from the control unit 250. The amplifier 270 could be implemented in any number of ways known in the art, and no further details need be provided here. It is contemplated that the control unit 250 and the amplifier 270 could be replaced with an amplifier with wireless receiver capabilities in some implementations. As with the control unit 250, the amplifier 270 should be sufficiently water resistant to protect its electronics from the possibility of water damage.

Figure 11:
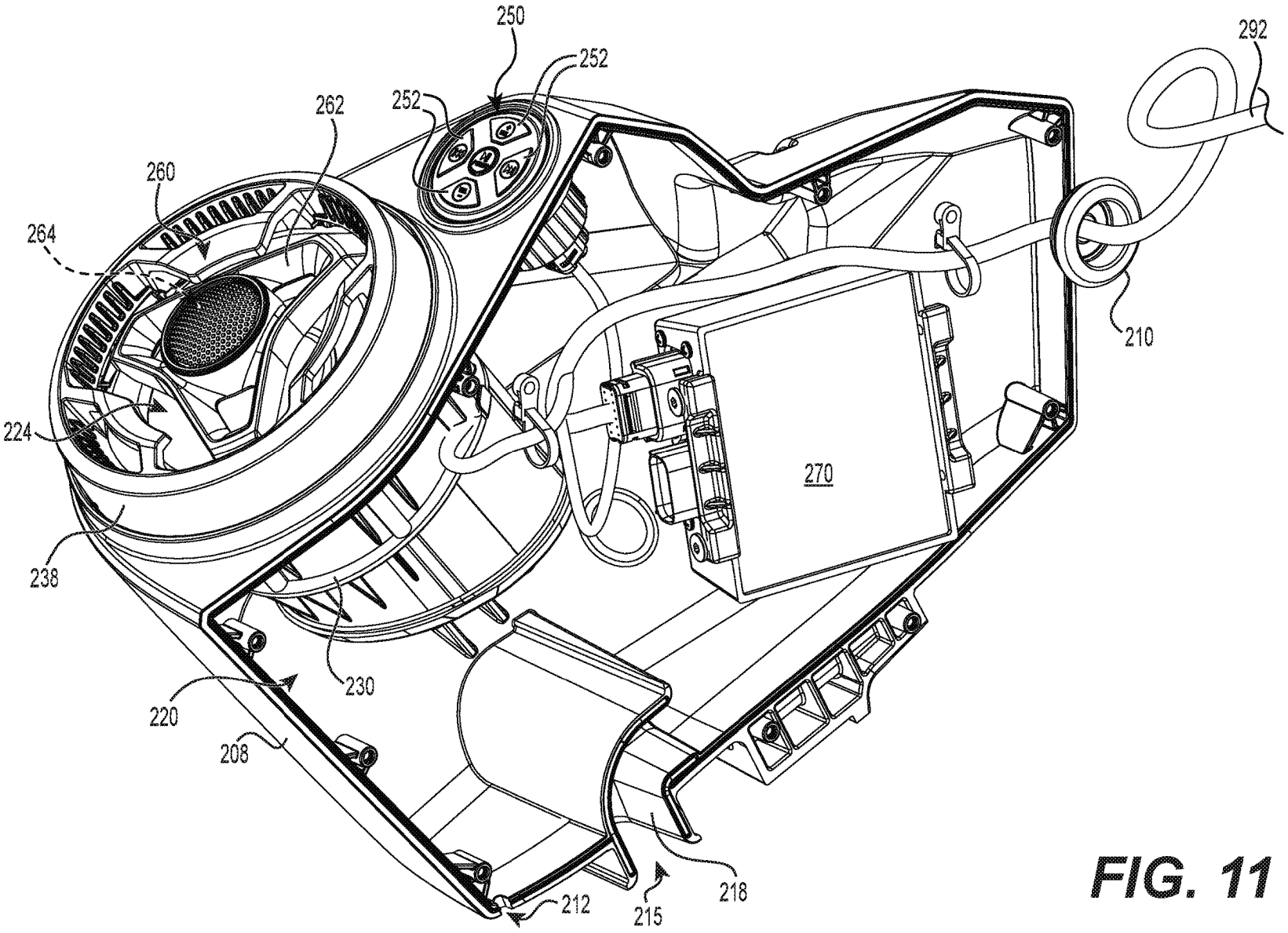
FIG. 11 is a rear, right side perspective view of the speaker assembly portions of FIG. 10.

The control unit 250 and the amplifier 270 are electrically connected to and powered by the battery 92 disposed between the deck 24 and the hull 22 by the cord 292. The cord 292 extends from the amplifier 270, the amplifier 270 being is in turn connected to the control unit 250, as illustrated in FIG. 11. The cord 292 then extends through the grommet 210 and under a top surface of the deck 24 and connects to the battery 92, as can be seen schematically in FIG. 1. The cord 292 also connects to the right speaker assembly 201 for providing power and electronic signals thereto, as will be described below. It is contemplated that the speaker assembly 200 could connect to a different power source, for example a battery disposed within the housing 204. It is also contemplated that the cord 292 could be replaced with a plurality of electrical cords or cables, depending on specifics of the implementation.

Figure 15:
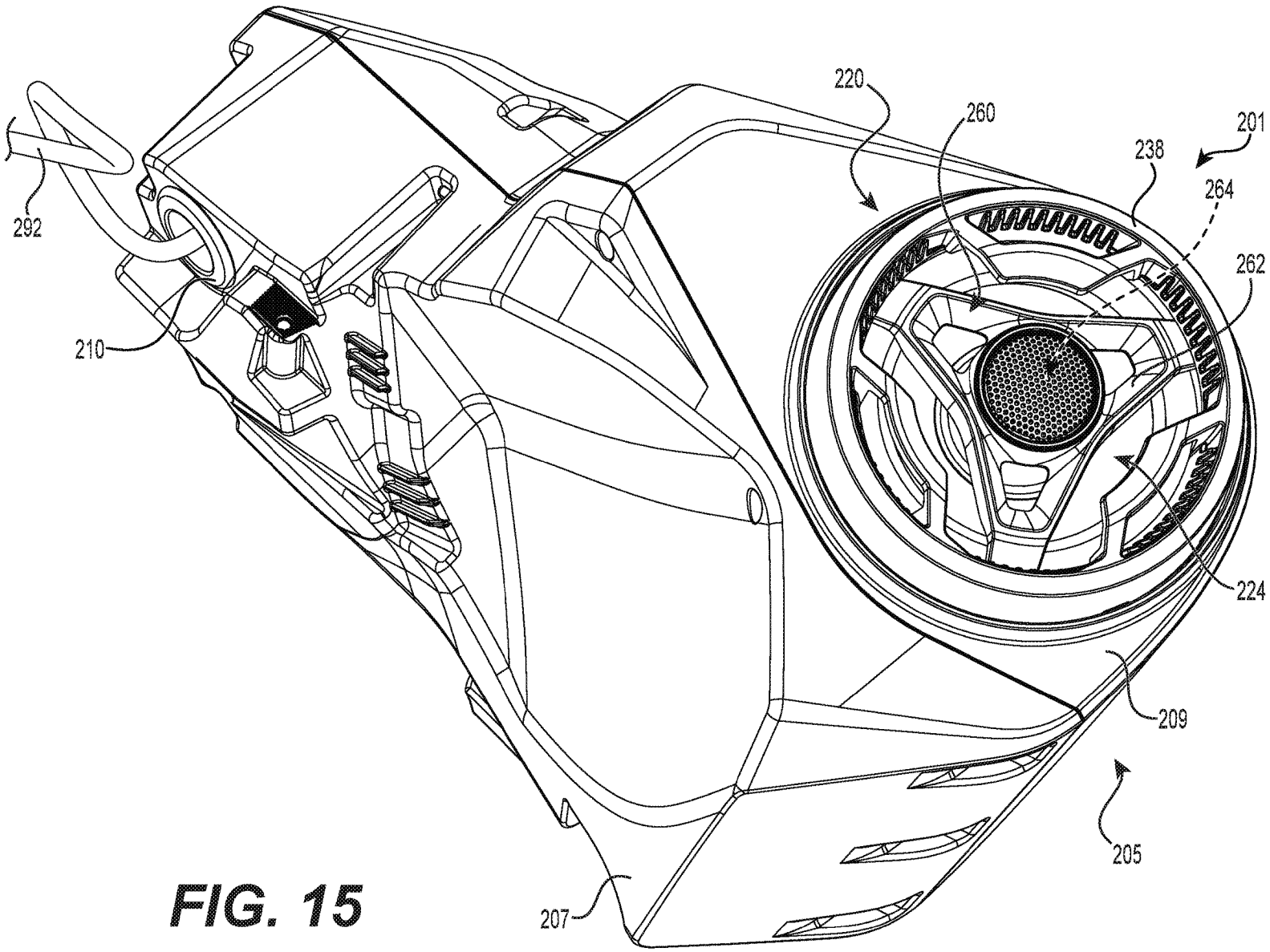
FIG. 15 is a top, rear, left side perspective view of a right speaker assembly of the watercraft of FIG. 1.
Figure 16:
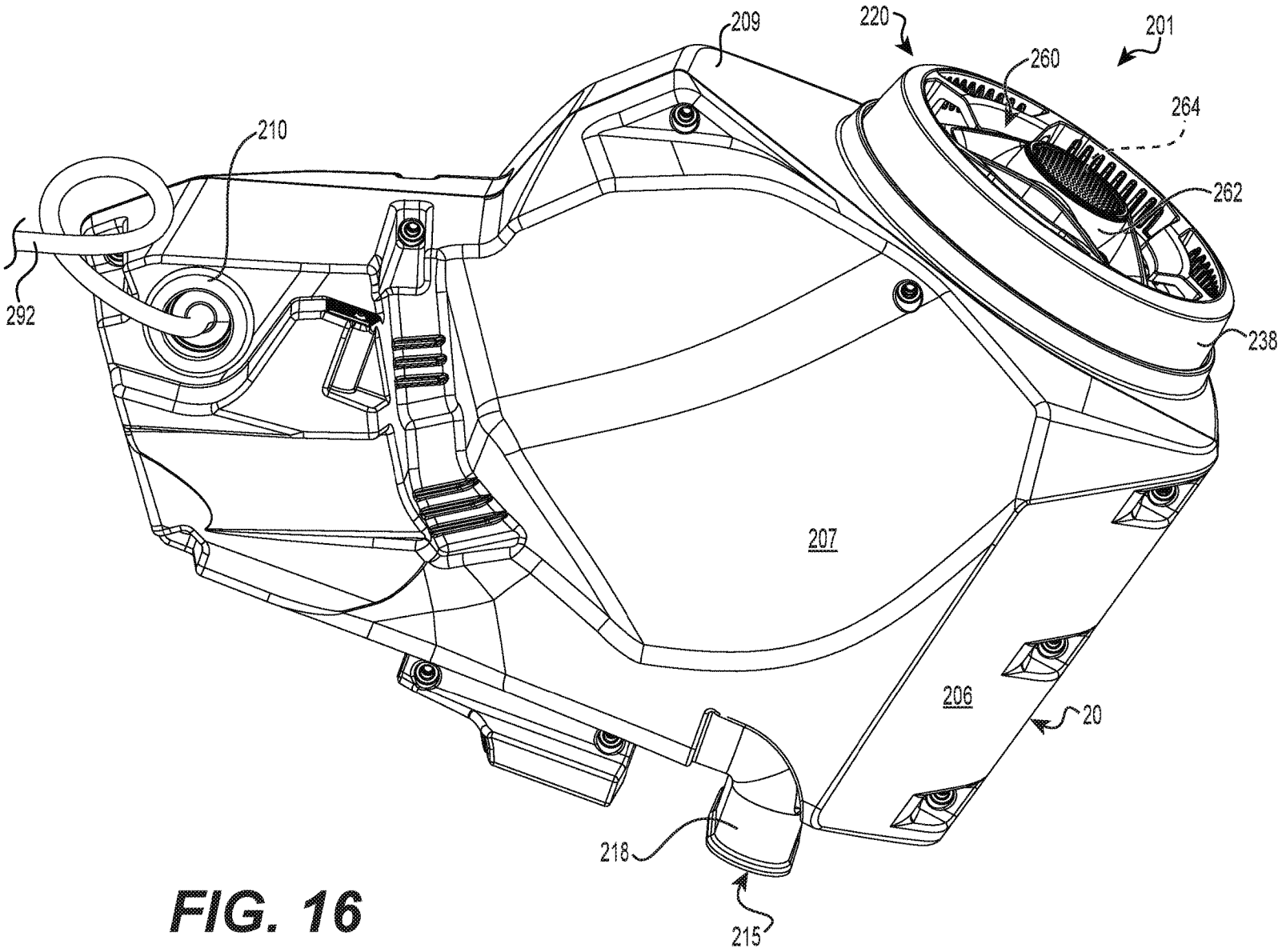
FIG. 16 is a left side elevation view of the right speaker assembly of FIG. 15.
Figure 17:
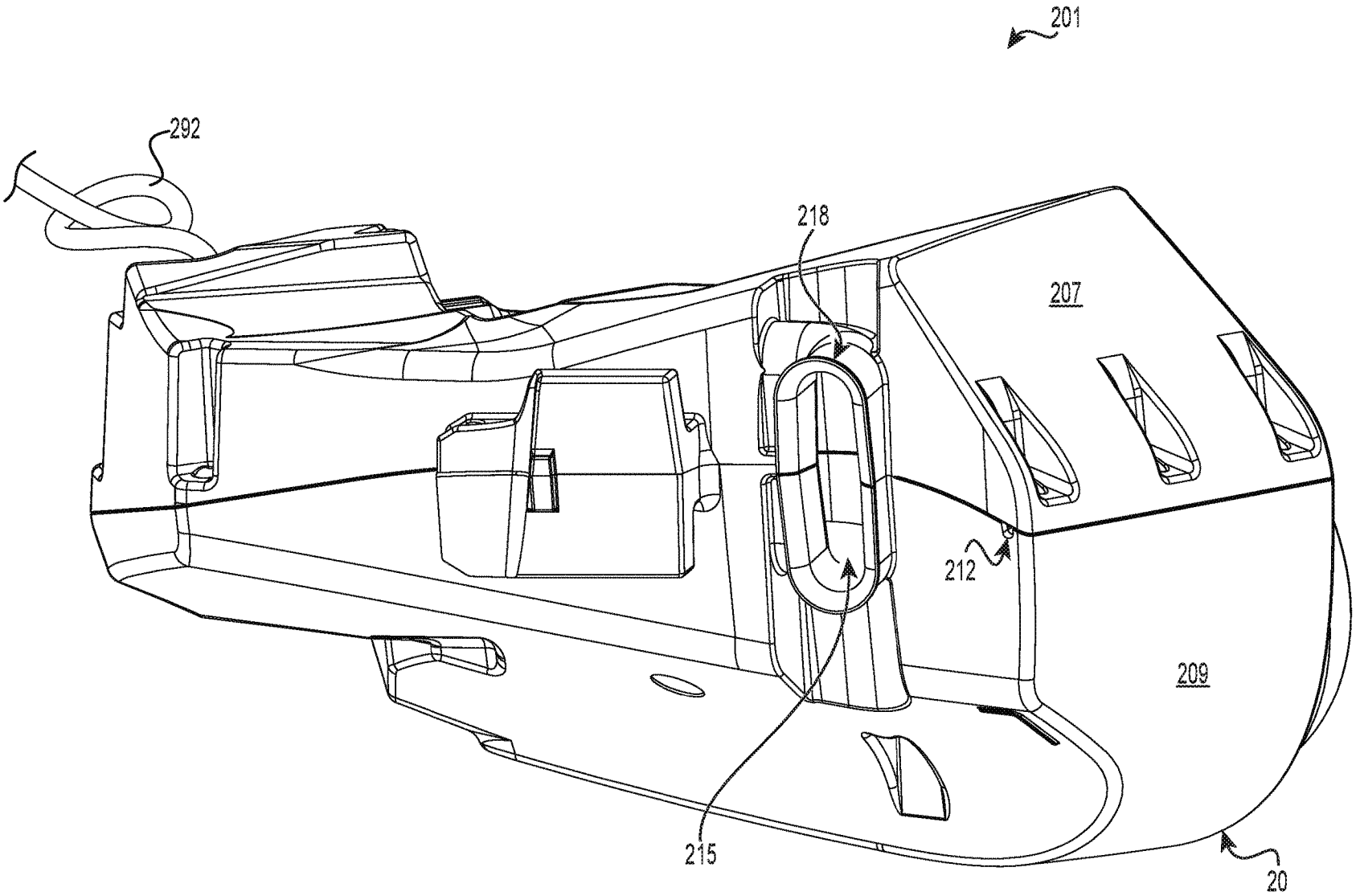
FIG. 17 is a bottom plan view of the right speaker assembly of FIG. 15.

The speaker assembly 201, illustrated in FIGS. 15 to 17, will now be described in more detail. The speaker assembly 201 is similar to the speaker assembly 200, and only differences will be discussed. The speaker assembly 201 is disposed at a front end of the right foot-well 82. It is contemplated that the positions of the speaker assemblies 200, 201 could be reversed (though some changes to specific design details may be necessary). It is also contemplated that the speaker assembly 201 could be omitted in some implementations.

The speaker assembly 201 includes a housing 205, made of an inner panel 207 and an outer panel 209 connected together. The inner panel 207 is a mirror image of the inner panel 206 of the assembly 200. The outer panel 209 is nearly a mirror image of the outer panel 208, although the outer panel 209 does not have a hole through which the control unit 250 is inserted (see FIG. 9).

The speaker assembly 201 includes its own speaker driver 220, which is identical to the speaker driver 220 of the speaker assembly 200. It is contemplated that the speaker drivers 220 in the two speaker assemblies 200, 201 could be different in some implementations. The speaker assembly 201 does not, however, include the control unit 250 or the amplifier 270 of the speaker assembly 200. The speaker driver 220 of the speaker assembly 201 is powered and controlled by the control unit 250 and the amplifier 270 of the speaker assembly 200, as mentioned above. The speaker driver 220 of the right speaker assembly 201 is electrically and electronically connected to the control unit 250 and the amplifier 270 via the cord 292. It is contemplated that the speaker assembly 201 could be provided with some additional controls specific to the speaker assembly 201, such as volume controls, etc. It is contemplated that the speaker assembly 201 could include its own control unit 250 and amplifier 270 which wirelessly connects to the user device separately from the left speaker assembly 200. It is also contemplated that the speaker assembly 201 could include the amplifier 270 that connects by the cord 292 or wirelessly to the control unit 250 of the speaker assembly 200.

Operational details of the speaker drivers 220 of the speaker assemblies 200, 201 will now be described, with reference mainly to the speaker driver 220 of the speaker assembly 200. The details apply mutatis mutandis to the speaker assembly 201.

As mentioned above, the basket 230 defines a plurality of apertures 232. As can be seen from FIGS. 12 to 14, an inner surface 225 of the cone 224 is in fluid communication with the air surrounding the basked 230 within the housing 204 via these apertures 232. Bass frequencies produced by the cone 224 can thus propagate into the interior of the housing 204.

As is known in the art, the bass port 215 is one or more apertures that enable the sound from a rear side, i.e. the surface 225, of the cone 224 to be better transmitted of out of the housing 204, especially bass frequencies. The specific design of the bass port 215 and the pipe 218 depends on many factors, including but not limited to: volume of the housing 204, the frequencies to be transmitted, and different operational parameters of the speaker driver 220.

Figure 5:
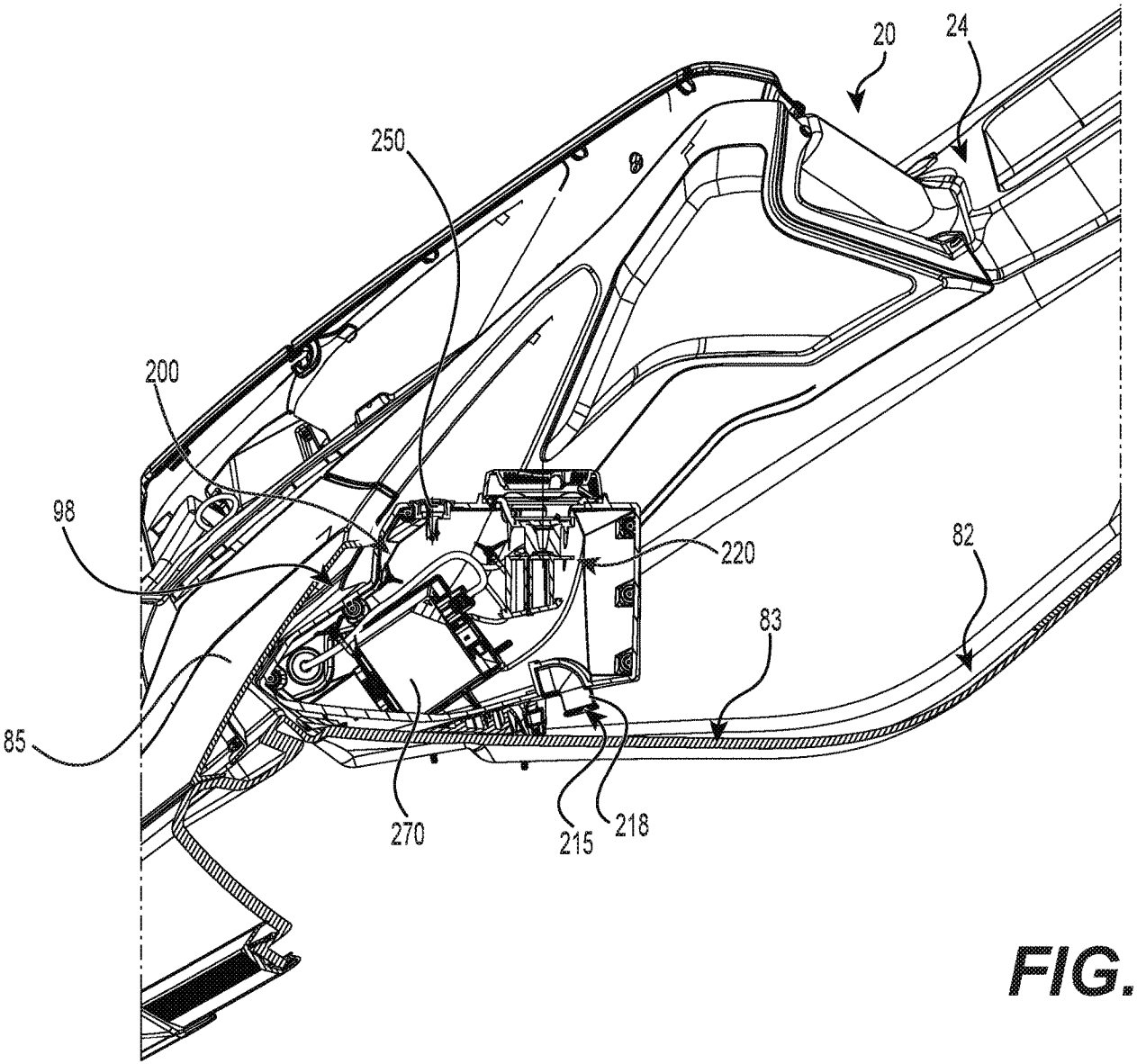
FIG. 5 is a cross-sectional view of a portion of the deck of FIG. 4 taken along line 5-5 of FIG. 4.
Figure 6:
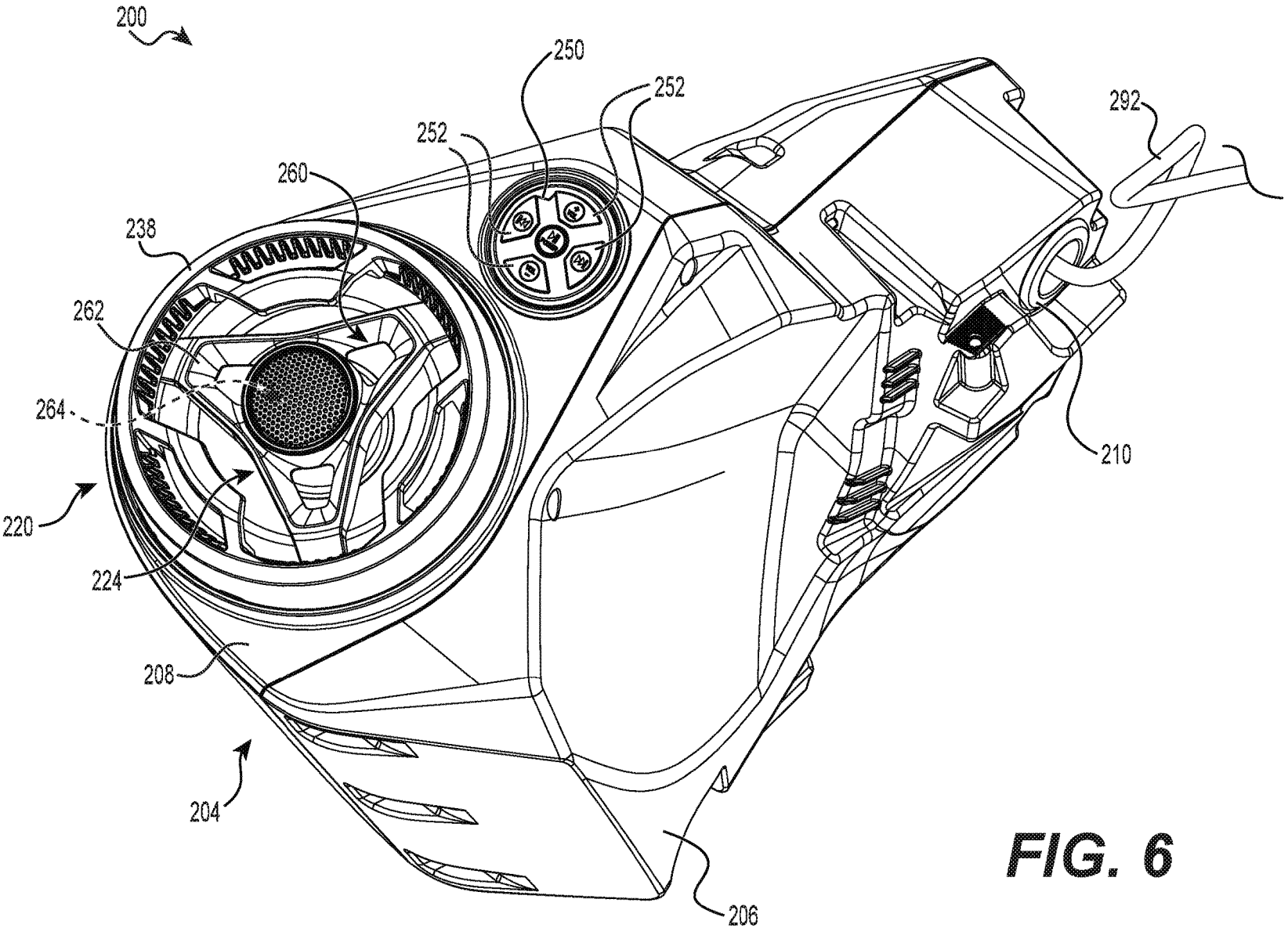
FIG. 6 is a top, rear, right side perspective view of a left speaker assembly of the watercraft of FIG. 1.
Figure 10:
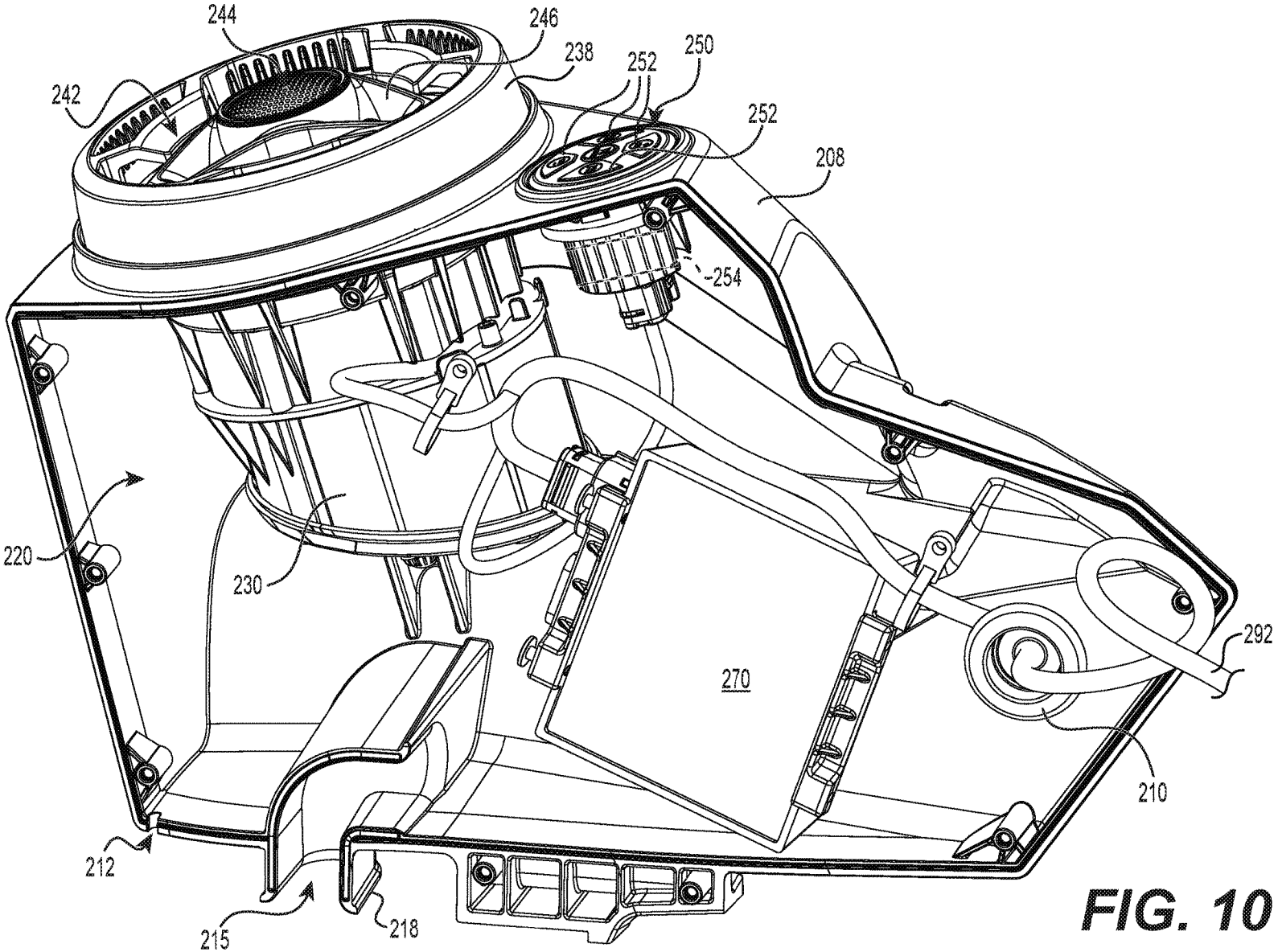
FIG. 10 is a front, right side perspective view of the left speaker assembly of FIG. 6, with an inner housing panel having been removed.
Figure 12:
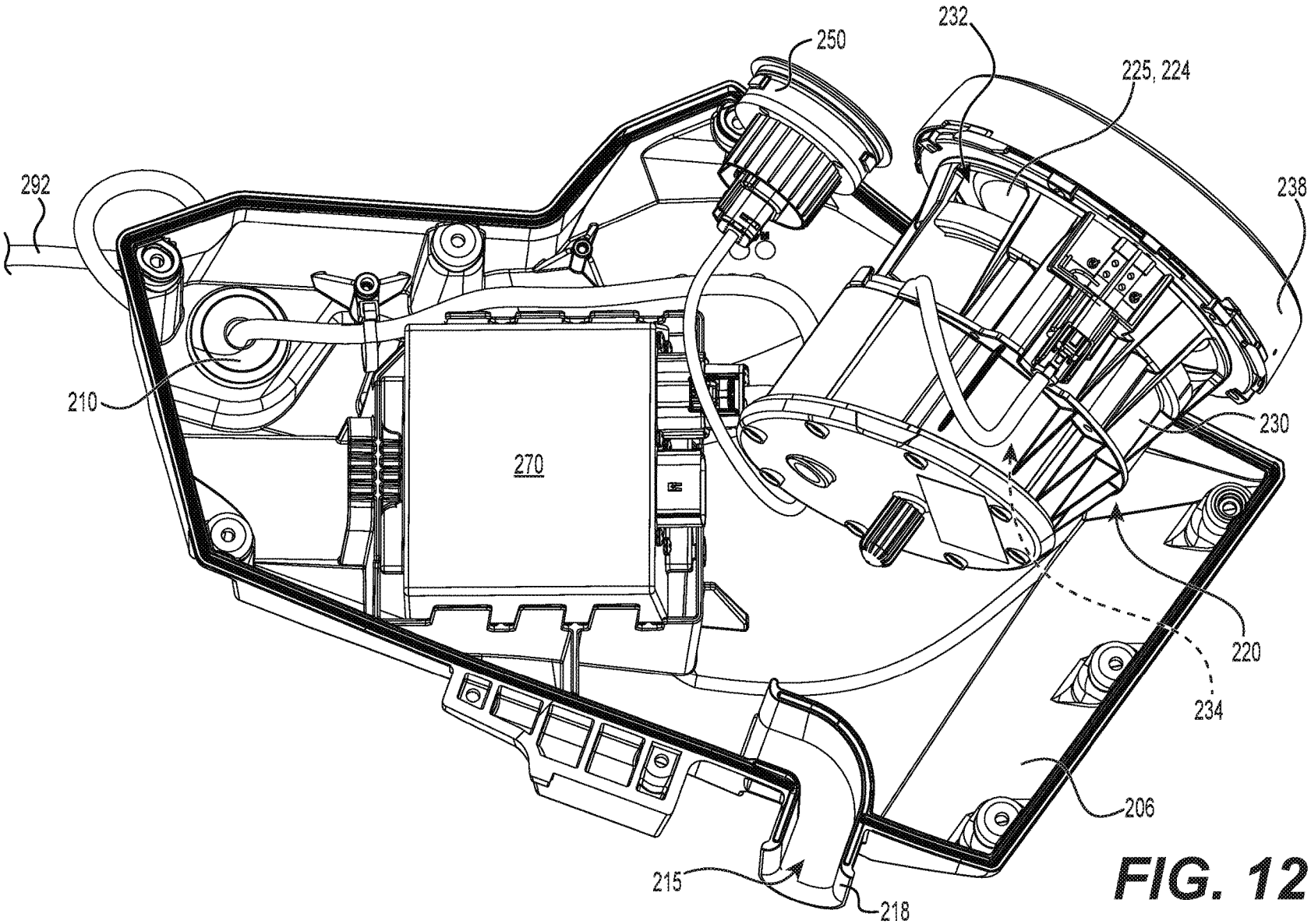
FIG. 12 is a bottom, left side perspective view of the left speaker assembly of FIG. 6, with an outer housing panel having been removed.

In the present implementation, the pipe 218 is formed partially on a foot-well side of the speaker assembly 200, which is the surface of the housing 204 nearest the foot-well 82. The pipe 218 extends out of the housing 204, as well as into an interior of the housing 204. The pipe 218 forms an elbow shape as can be seen in FIGS. 10 to 12, although the exact shape of the pipe 218, including its length and cross-section, will depend on specific details of the speaker driver 220 and the housing 204 in any given implementation. Depending on the specific design, the pipe 218 could be contained entirely within the housing 204, or could be disposed mostly external to the housing 204. As can be seen in FIG. 5, the bass port 215 is oriented to face the foot-well 82, and specifically the angled portion 83 of the foot-well 82. As such, the foot-well portion 83 reflects at least a portion of the sound waves transmitted out of the bass port 215 generally toward the operator of the watercraft 20.

By allowing the bass port 215 to be open facing the foot-well 82, sound quality can be improved, as discussed above. While water is likely to splash into the foot-wells 82 of the watercraft 20 at some point during operation of the watercraft 20 and thus also into the speaker assembly 200 through at least the bass port 215, the voice coil assembly 242 is sealed in the water impermeable chamber 234 and will be generally unaffected. Inclusion of the water impermeable spider 240 further allows the surround 228 and the cone 224 to be permeable in some manner, as water entering from the cone side of the housing 204 will not damage the electric and electronic components within.

The speaker drivers 220 of the left and right speaker assemblies 200, 201 are also oriented to aid in improving sound for the operator. As can be seen from FIGS. 1, 2, and 14, the orientation of the speaker drivers 220 can be generally defined by a centerline 202 of the cone 224 of the speaker driver 220 of the speaker assembly 200 and a centerline 203 of the cone 224 of the speaker driver 220 of the speaker assembly 201. The centerlines 202, 203 extend upward and rearward from their respective speaker assembly 200, 201 such that sound emanating from the speaker drivers 220 is directed at least partially upward and rearward from the corresponding speaker assembly 200, 201. As such, the sound emanating from the speaker drivers 220, especially sound created by outward-facing portion of the cone 224 and the tweeter assembly 260, is generally directed toward the operator of the watercraft 20. The centerlines 202, 203 also each extend partially laterally inward from their respective speaker assemblies 200, 201 such that sound emanating from the speaker drivers 220 is further directed at least partially laterally inward from the speaker assemblies 200, 201. The centerlines 202, 203 intersect generally in the space above the seat 70, but it is contemplated that the centerlines 202, 203 could intersect elsewhere.

Specifically, the centerline 202 of the cone 224 of the speaker driver 220 of the left speaker assembly 200 extends upward, rearward, and rightward from the left speaker assembly 200 such that sound emanating from the left speaker driver 220 is directed at least partially upward, rearward, and rightward from the left speaker assembly 200. Similarly, the centerline 203 of the cone 224 of the speaker driver 220 of the right speaker assembly 201 extends upward, rearward, and leftward from the right speaker assembly 201 such that sound emanating from the right speaker driver 220 is directed at least partially upward, rearward, and leftward from the right speaker assembly 201.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A personal watercraft comprising:
- a hull;
- a deck disposed on the hull, the deck including:
  - a pedestal,
  - a left foot-well disposed on a left side of the pedestal, and
  - a right foot-well disposed on a right side of the pedestal;
- at least one straddle seat disposed on the pedestal;
- a motor disposed between the hull and the deck;
- a propulsion system connected to at least one of the hull and the deck and operatively connected to the motor; and
- at least one speaker assembly disposed at a forward portion of at least one of the left foot-well and the right foot-well, the at least one speaker assembly comprising:
  - a housing defining a bass port, the bass port facing a surface of the at least one of the left foot-well and the right foot-well for reflecting at least a portion of soundwaves transmitted out of the bass port off of the surface, and a water resistant speaker driver connected to the housing, the speaker driver comprising:

a basket connected to the housing, the basket defining a plurality of apertures, at least a portion of the basket being disposed in an interior of the housing, the plurality of apertures being disposed in the interior of the housing, a cone supported by the basket, a surface of the cone fluidly communicating with air surrounding the basket via the plurality of apertures, a dust cap connected to the cone, a suspension element operatively connected to the cone and the basket, and a water resistant voice coil assembly operatively connected to the cone.

2. The personal watercraft of claim 1, wherein the at least one speaker assembly further comprises an amplifier disposed within the housing, the amplifier being electrically connected to and adapted for driving the speaker driver.

3. The personal watercraft of claim 1, wherein:

the bass port is defined by a pipe defined at least in part by a foot-well side surface of the housing, the foot-well side surface being a surface of the housing nearest to the at least one of the left foot-well and the right foot-well.

4. The personal watercraft of claim 1, wherein:

the surface of the at least one of the left foot-well and the right foot-well is an angled surface disposed at the forward portion of the at least one of the left foot-well and the right foot-well.

5. The personal watercraft of claim 1, wherein the at least one speaker assembly further comprises a control unit connected to the housing, the control unit being electronically connected to the speaker driver.

6. The personal watercraft of claim 5, wherein:

the control unit includes buttons disposed on a top portion of the control unit for controlling operation of the speaker driver; and the top portion of the control unit is disposed on an external surface of the housing.

7. The personal watercraft of claim 5, wherein the control unit comprises a wireless receiver for connecting wirelessly with a user electronic device.

8. The personal watercraft of claim 1, wherein the speaker driver further comprises:

a surround connected to an edge of a geometric base of the cone; and a waterproof tweeter assembly connected to the basket, the basket connecting the speaker driver to the housing.

9. The personal watercraft of claim 1, wherein a centerline of the cone of the speaker driver extends upward and rearward from the speaker assembly such that sound emanating from the speaker driver is directed at least partially upward and rearward from the speaker assembly.

10. The personal watercraft of claim 9, wherein the centerline of the cone extends laterally inward from the speaker assembly such that sound emanating from the speaker driver is directed at least partially laterally inward from the speaker assembly.

11. The personal watercraft of claim 1, wherein the housing defines at least one drainage hole for allowing at least a portion of water passing into the housing to drain out of the at least one speaker assembly.

12. The personal watercraft of claim 1, further comprising a battery; and wherein the at least one speaker assembly is electrically connected to the battery for receiving power therefrom.

13. The personal watercraft of claim 1, wherein:

the at least one speaker assembly includes a left speaker assembly and a right speaker assembly;

the left speaker assembly is disposed at the forward portion of the left foot-well; and the right speaker assembly is disposed at the forward portion of the right foot-well.

14. The personal watercraft of claim 13, further comprising:

a power source; and wherein:

one of the right speaker assembly and the left speaker assembly further comprises:

an amplifier connected to the speaker driver and the power source, and a control unit connected to the speaker driver and the power source; and an other one of the right speaker assembly and the left speaker assembly is connected to the amplifier and the control unit via a cable disposed under a top surface of the deck, the other one of the right speaker assembly and the left speaker assembly being controlled and powered via the cable.

15. The personal watercraft of claim 14, wherein the control unit comprises a wireless receiver for connecting wirelessly with a user electronic device.

16. The personal watercraft of claim 13, wherein:

a centerline of the cone of the speaker driver of the left speaker assembly extends upward, rearward, and rightward from the left speaker assembly such that sound emanating from the left speaker driver is directed at least partially upward, rearward, and rightward from the left speaker assembly; and a centerline of the cone of the speaker driver of the right speaker assembly extends upward, rearward, and leftward from the right speaker assembly such that sound emanating from the right speaker driver is directed at least partially upward, rearward, and leftward from the right speaker assembly.

17. A personal watercraft comprising:

a hull;

a deck disposed on the hull, the deck comprises:

at least one deck panel;

a pedestal;

a left foot-well disposed on a left side of the pedestal; and a right foot-well disposed on a right side of the pedestal;

at least one straddle seat disposed on the pedestal;

a motor disposed between the hull and the deck;

a propulsion system connected to at least one of the hull and the deck and operatively connected to the motor; and at least one speaker assembly disposed at a forward portion of at least one of the left foot-well and the right foot-well, the at least one speaker assembly comprising:

a housing defining a bass port; and a water resistant speaker driver connected to the housing, the speaker driver comprising:

a basket connected to the housing, the basket defining a plurality of apertures, at least a portion of the basket being disposed in an interior of the housing, the plurality of apertures being disposed in the interior of the housing;

a cone supported by the basket, a surface of the cone fluidly communicating with air surrounding the basket via the plurality of apertures;

a dust cap connected to the cone;

a suspension element operatively connected to the cone and the basket; and a water resistant voice coil assembly operatively connected to the cone;

the at least one deck panel defining a recess for selectively receiving the housing of the at least one speaker assembly partially therein; and lateral sides of the housing of the at least one speaker assembly being at least partially covered by the at least one deck panel.

18. A personal watercraft comprising:

a hull;

a deck disposed on the hull, the deck including a pedestal, the deck defining at least one recess, the recess opening rearwardly and upwardly from the deck;

at least one straddle seat disposed on the pedestal;

a motor disposed between the hull and the deck;

a propulsion system connected to at least one of the hull and the deck and operatively connected to the motor; and at least one speaker assembly disposed in the at least one recess, the at least one speaker assembly comprising:

a housing disposed at least in part in the at least one recess, and a speaker driver connected to the housing, the speaker driver comprising:

a basket connected to the housing, at least a portion of the basket being disposed in an interior of the housing, a cone supported by the basket, a dust cap connected to the cone, a suspension element operatively connected to the cone and the basket, and a voice coil assembly operatively connected to the cone.

19. The personal watercraft of claim 18, wherein:

the deck comprises at least one deck panel; and lateral sides of the housing of the at least one speaker assembly are at least partially covered by the at least one deck panel.

* * * * *